US007066263B1

(12) United States Patent
Mouton

(10) Patent No.: US 7,066,263 B1
(45) Date of Patent: Jun. 27, 2006

(54) TENSION MULTIPLIER JAR APPARATUS AND METHOD OF OPERATION

(76) Inventor: David E. Mouton, 711 711 N. Beau Chene Dr., Mandeville, LA (US) 70471

( * ) Notice: Subject to any disclaimer, the term of this patent is extended or adjusted under 35 U.S.C. 154(b) by 193 days.

(21) Appl. No.: 10/647,927

(22) Filed: Aug. 26, 2003

Related U.S. Application Data

(60) Provisional application No. 60/406,227, filed on Aug. 27, 2002.

(51) Int. Cl.
*E21B 31/113* (2006.01)

(52) U.S. Cl. ..... 166/301; 166/178; 175/297

(58) Field of Classification Search ..... 166/98, 166/99, 178, 301; 175/297
See application file for complete search history.

(56) References Cited

U.S. PATENT DOCUMENTS 3,724,576 A 4/1973 Roberts
4,844,183 A * 7/1989 Evans ..... 175/296
4,846,273 A 7/1989 Anderson et al.
5,232,060 A 8/1993 Evans
5,425,430 A 6/1995 Roberts
5,431,221 A 7/1995 Roberts et al.
5,503,228 A 4/1996 Anderson
5,584,353 A * 12/1996 Chancey et al. ..... 175/297
5,918,688 A 7/1999 Evans
6,290,004 B1 9/2001 Evans

* cited by examiner

*Primary Examiner*—Zakiya W. Bates
(74) *Attorney, Agent, or Firm*—Garvey, Smith, Nehrbass & North, L.L.C.; Gregory C. Smith

(57) ABSTRACT

A tension multiplier jar apparatus which multiplies the tension by a multiple factor using a compressible energizing fluid acting on differential areas to provide greater over-pull to jar objects in the well. There is first included an overall assembly which includes a lowermost anvil and metering sub attached on its upper end to a hammer and compression sub which is secured on its upper end to a multiplier sub which is secured on its upper end to a fourth upper spline sub. In additional embodiments there is provided a spring such as Belleville springs or coiled springs to replace the energizing fluid as well as downward firing tool that can be activated without any external attachment to the wellbore. There is further provided a mechanism for cocking and firing the tool in place of the metering system.

24 Claims, 23 Drawing Sheets

TENSION MULTIPLIER JAR APPARATUS AND METHOD OF OPERATION

CROSS-REFERENCE TO RELATED APPLICATIONS

Priority of U.S. Provisional Patent Application Ser. No. 60/406,227, filed Aug. 27, 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The apparatus of the present invention relates to jarring tools used in downhole drilling. More particularly, the present invention relates to an improved apparatus for jarring including pipe, coil-tubing and wireline tools downhole, by multiplying the tension to provide greater over-pull to a jarring apparatus downhole tools, and a method of achieving same.

2. General Background of the Invention

In the efforts to dislodge the drill pipe or activate tools in a well, a type of tool known as a jarring tool would be used in such an attempt. In the current state of the art, jarring tools as they currently utilize may be used to either jar either in the up or down direction, depending on the makeup of the tool. The present invention can also be used in similar applications such as coiled tubing and wireline operations. This apparatus and system can be used in deviated/horizontal wells where it is difficult to obtain over-pull at the stuck point due to drag. It could be utilized in rig-limited operations where the rig or crane is not capable of providing sufficient over-pull, or in coiled tubing or wireline operations where over-pull is minimal due to tension limitations.

Certain patents have been obtained which address the method of jarring tools in a borehole; however, none have the ability to multiply tension as the present invention. The prior art will be provided in the prior art statement submitted herewith.

BRIEF SUMMARY OF THE INVENTION

The apparatus and method of operation of the present invention solves the problems in the art in a simple and straightforward manner. What is provided is a tension multiplier jar apparatus which multiplies the tension by a multiple factor to provide greater over-pull to a jarring apparatus. In a first embodiment, energy is stored in the form of a compressible fluid by virtue of a long stroke acting on a small piston area developed by the available overpull. As the jar is fired, this area is released over a relatively short stroke; however, by virtue of the larger reactive area, the upward force is then multiplied by a factor determined by the geometry of the tool and precompressed value of the fluid. It is foreseen that by virtue of the differential areas in the multiplier sub, the overpull to the general apparatus is multiplied by a factor of between 1.2 and 15, or greater with the usual range of approximately 5–10. There is first included an overall assembly which includes a lowermost anvil and metering sub attached on its upper end to a hammer and compression sub which is secured on its upper end to a multiplier sub which is secured on its upper end to a fourth upper spline sub. The four subs attached thereto define the tool assembly of the present invention. There is incorporated a compression tube extending throughout the entire assembly for serving as a means of transmitting the required incremental compressional load due to the effects of the tension multiplier. The multiplier sub would include a nitrogen filled chamber between the compression tube and the spline sub, so that as the upper spline sub is pulled upwardly, it in turn compresses the nitrogen within the nitrogen chamber in the multiplier sub. At this point, the sub is fully cocked or "energized," and there is included a metering fluid which begins to meter slowly as the tool is being cocked, and when the fluid has metered out, the hammer portion is forced upward by the pressurized nitrogen making a jarring contact between the anvil and the compression tube. This upward jarring motion would tend to pull the tool attached to the lower end of the compression tube in an upward direction and dislodge the tool stuck downhole. This process of course could be repeated again and again until such time as the tool is dislodged from downhole.

In another embodiment, a CTU or slickline embodiment would include an upper and lower chamber with preset gas charges dependent upon the depth/pressure of the well.

In other principal embodiments the pressurized nitrogen gas is augmented by spring means, such as Belleville or coiled springs, which serve to energize the sub for undertaking its jarring motion.

For example, in one embodiment a coil-tubing or slickline embodiment would utilize a hybrid spring system incorporating an incompressible fluid energizing a set of Belleville springs. This tool is hydrostatically balanced, i.e., can be run to any depth or pressure without presetting a gas charge or "dome." Options include a compensated nitrogen "dome" in lieu of the Belleville springs, a mechanical latching mechanism (versus a hydraulic metering system), and a gas filled nitrogen return spring system. Additional weight items can be added to the top of the tool, if desired.

In another embodiment, a coil-tubing or slickline embodiment utilizes a hybrid spring system incorporating an incompressible fluid energizing an exterior helical spring, eliminating seal friction during the jarring process as well as hysteresis of Belleville springs. A simple mechanical latching system is incorporated using the total stroke of the tool, which is directly related to the amount of overpull applied. The firing stroke or tension can be varied by changing the length of the internal rod, as well as adjustment of the jarring stroke by inserting different sets of anvil pins.

In yet another embodiment, a downward jarring tool utilizes the weight of the tool itself to store energy in an enclosed helical spring. For example, if the weight of the tool is 100 pounds, the tool can be set to fire with 50 pounds of overpull. A multiplying factor on the order of 8 to 10 results in a downward firing jar of 400 to 500 pounds. Optionally, if the tool can be located in a "nipple" or prerun recess in the tubing, additional overpull can be employed (above the weight of the tool) and significantly higher downward jarring forces can be obtained.

Therefore, it is the principal object of the present invention to provide a jarring apparatus by a process of multiplying the tension by multiple factors so as to provide greater jarring forces in the well.

It is a further object of the present invention to multiply the force exerted against the object downhole by employing a compressive inner tool that allows the multiplication of force possible in providing a suitable reaction chamber to the incremental (multiplicative part) force component.

It is the further object of the present invention to undertake a process which utilizes a nitrogen filled chamber, the overall effect by virtue of differential areas is a multiplication of the available tension force.

It is a further object of the present invention to provide a jarring process by multiplying the upward available jarring force against the tool due to differential areas acting on a filled fluid chamber within the tool.

It is a further object of the present invention to provide a jarring method which provides for a process of energizing the tool by compressing a fluid such as nitrogen into an upward chamber, and during compression allowing a metering of a second fluid so that when the fluid is metered out the compressed nitrogen forces a multiplied upward tension and a significant upward hammering affect on the tool which is stuck downhole.

It is a further object of the method of the present invention to position the apparatus above a tool; energizing the tool by pressurizing a fluid in the apparatus; metering of a second fluid in the apparatus; reaching a point where the pressurized fluid is able to decompress in sufficient force to provide a jarring upward force on the tool in order to dislodge the tool from downhole.

It is a further object of the present invention to utilize the invention on pipe, wireline, coil tubing, slick line, or other similar types of systems.

It is a further object of the present invention to provide a tension multiplying jarring method for wireline or coil tubing use, not limited it to slick line, braided line or multi-conductor cable, which may induce jarring forces in multiples of 10 or more above applied tension force as well as energize downward jarring force;

It is a further object of the present invention to provide a tension multiplying jarring method and apparatus which incorporates two distinct fluid chambers which would be filled with nitrogen or other compatible or compressible fluids, as well as a metering mechanism also comprised of a compressible fluid;

It is a further object of the present invention to provide a tension multiplying jarring method and apparatus which in addition to providing pressurized fluid to energize the tool and firing the apparatus, there is incorporated a spring means such as a Belleville spring system or coil spring system, which augments the energizing and firing of the tool together with incompressible fluids in the tool;

It is a further object of the present invention to provide a tension multiplying jarring method where the hydrostatic pressure downhole is utilized to provide significant downward force;

It is a further object of the present invention to provide a tension multiplying jarring apparatus having three major moving components, i.e, a piston rod, external housing and internal shaft functioning in conjunction with compressible fluids and/or springs within the apparatus in order to energize the apparatus and, when fired apply both upward and downward jarring forces;

It is a further object of the present invention to provide tension multiplying jarring apparatus which allows the apparatus when utilized to deliver energized blows either upward or downward and whereby the tension multiplication is accomplished; and It is a further object of the present invention to provide a tension multiplying jarring method wherein the energized downward jarring force is assisted by the hydrostatic pressure within the bore hole.

BRIEF DESCRIPTION OF THE DRAWINGS

For a further understanding of the nature, objects, and advantages of the present invention, reference should be made to the following detailed description, read in conjunction with the following drawings, wherein like reference numerals denote like elements and wherein.

DETAILED DESCRIPTION OF THE INVENTION

FIGS. 1 through 19 illustrate a plurality of embodiments of the present invention. A discussion will be provided for each embodiment as illustrated in the Figures.

Figure 1A:
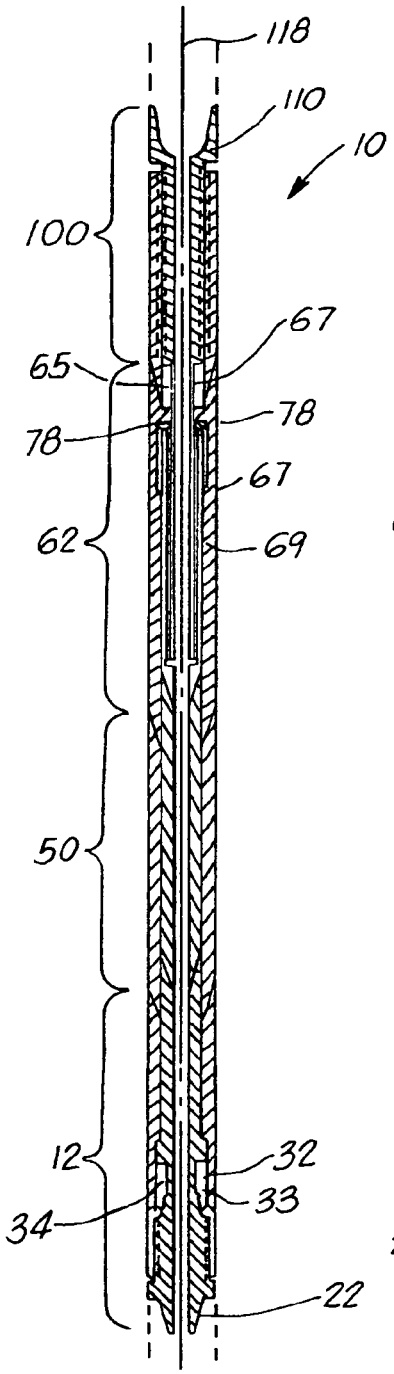
FIGS. 1A–1C illustrate overall views of the assembled apparatus of the present invention in the cocked, energized, and fired positions respectively.
Figure 1B:
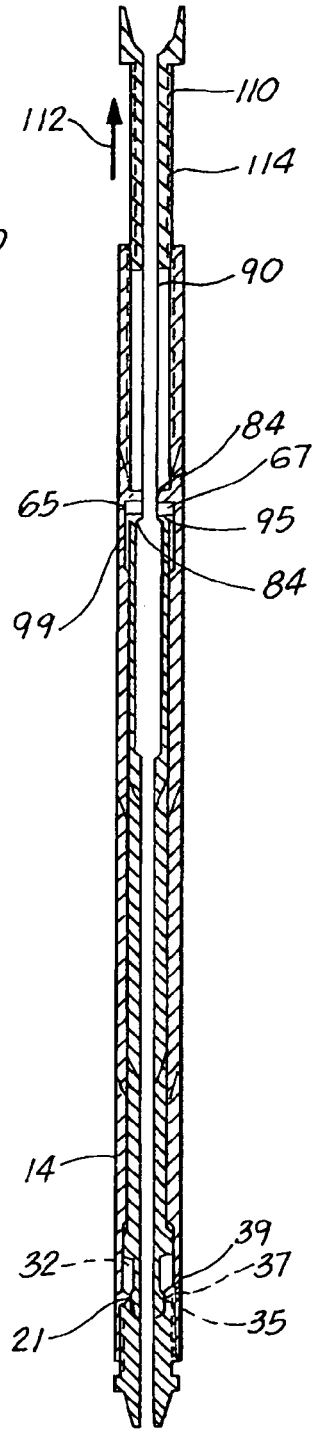
Figure 1C:
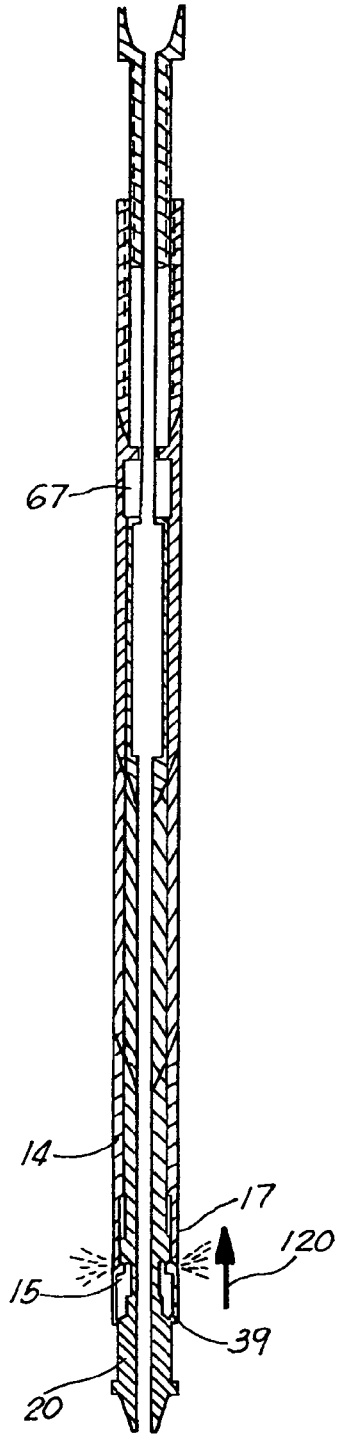

Initially, FIGS. 1A–8 illustrate the first preferred embodiment of the apparatus of the present invention by the numeral 10 (as seen in assembled view in FIGS. 1A–1C). Before turning to the assembled views as seen in FIGS.

1A–1C and 6 through 8 of the present invention, reference is first made to FIGS. 2–5 which illustrate the component parts of the present invention, prior to their being assembled into the requisite total assembly 10, as seen in FIGS. 1A–1C and 6 through 8.

In summary, the first preferred embodiment of the present invention is a pipe conveyed apparatus, with other embodiments including use with wireline, coil tubing or other suitable systems.

Figure 2:
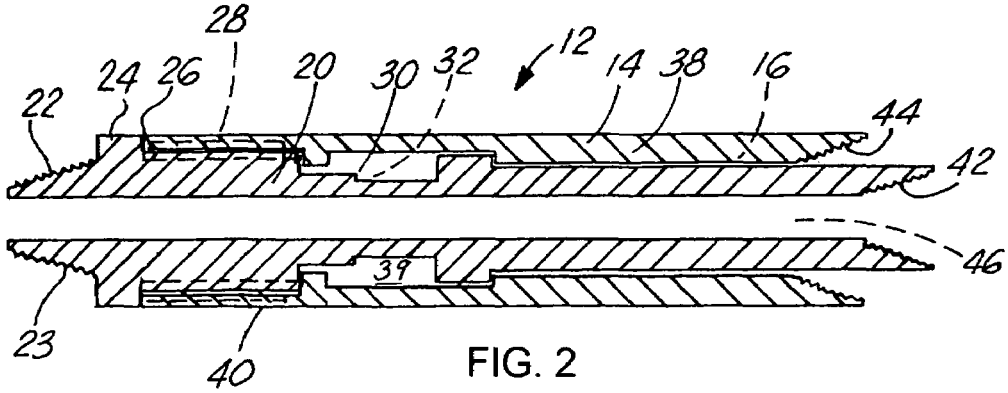
FIG. 2 illustrates the anvil and meter sub portion of the apparatus of the present invention.

As seen in FIG. 2, there is illustrated the anvil and meter sub portion 12 having a lower exterior hammer portion 14 which defines a continuous outer portion of the sub 12, having a bore 16 therethrough. As illustrated, the outer assembly 14 includes compression tube 20 within bore 16 which has a lower pin end 22, which has a shoulder portion 24 which engages onto the outer wall of the lower end 26 of assembly 14. There is included a series of spline members 28 which engage one another as illustrated in phantom view in FIG. 2. Compression tube portion 20 further includes a reduced throat area 30, which would define an annular space 32 which would be utilized to house a metering fluid 34 (as will be discussed further). It is seen that the space 32 would maintain the fluid 34 therein via a first upper O-ring 38 and a lower O-ring 40 positioned between the interior compression tube 20 and the outer assembly 14. The upper portion of tube 20 includes a female threaded end portion 42 which would threadably engage into the next upper section as will be discussed further. The outer assembly 14 includes a threaded female section 44 which likewise will threadably engage the next upper outer hammer portion as will be discussed further. There is also included an internal bore 46 through sub 12 for allowing the passage of fluid or like during operation. It is important to note that the lower pin portion 22 would be that portion which would be attached to either a fishing overshot, wireline or coil tubing pulling tool or the stuck tool itself by threadably engaging onto a tool or section pipe through thread members 23 on end portion 22.

Figure 3:
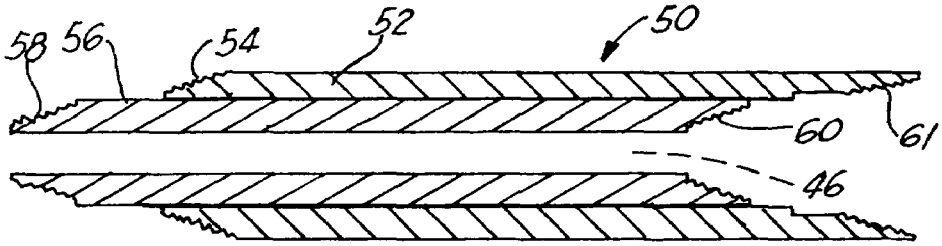
FIG. 3 illustrates the hammer and compression sub of the apparatus sub portion of the apparatus of the present invention.

Turning now to FIG. 3, FIG. 3 illustrates the next section of the assembly which would be the hammer and compression sub 50. Hammer and compression sub 50, like the lower sub 14 likewise includes an exterior hammer portion 52 which has a lower threaded pin member 54 which would threadably engage to the female end 44 of the lower sub 14, to define a continuous outer hammer portion 14, 52, in these two first portions of the assembly. The hammer portion 52 also includes an interior compression tube portion 56 which has a lower male end 58 which threadably engages to the female end 42 of the lower sub, which has an upper female end 60, which would threadably engage to the next highest sub as which will be explained further. Like the previous sub, there is also included a continuous other bore 46 therethrough for the reasons as noted. For a typical operation, there would be a plurality of these subs to provide a sufficient hammer mass.

Figure 4:
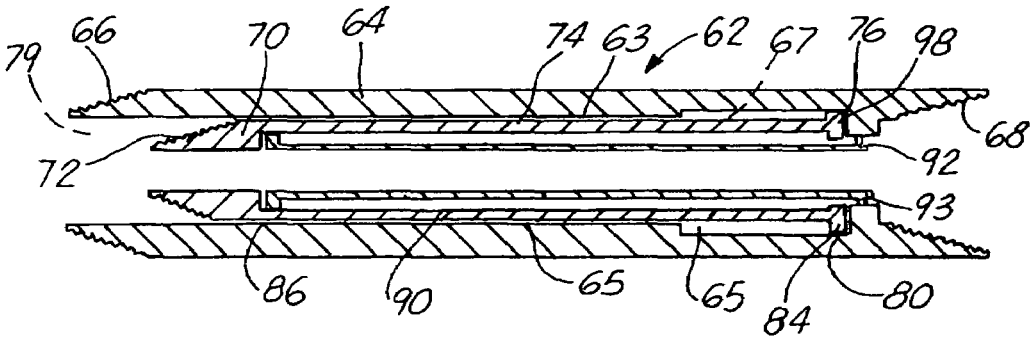
FIG. 4 illustrates the multiplier sub portion of the apparatus of the present invention.

Turning now to FIG. 4, reference is made to the next sub in the assembly which could be called the multiplier sub member 62. Again, multiplier sub member 62 has an outer hammer portion 64 which has a male threaded lower end portion 66 which is threadably engaged to the upper female end portion 61 of the lower hammer portion 52. And also the upper portion of the hammer 64 would include a female end portion 68 which would likewise thread to the next highest sub as will be discussed further. Like the other two subs 12 and 50, there is also included an interior tube 70 which likewise would have a lower male end portion 72 which is threadably engaged to the upper female end 60 of sub 50 and would have a continuous wall portion 74 therein. The upper portion of tube 70 would include an end portion 76 which would rest against an upper shoulder 78 of hammer 64 as illustrated in the Figures. As illustrated, the interior wall 63 of multiple sub 64 would define an enlarged chamber 67 at its upper portion, with the upper end 76 of tube 70 defining an upper shoulder 80 which would allow tube 70 to move upward and downward within the opening 79 defined by hammer portion 64 as will be discussed further. The chamber 67 would house a fluid such as precharged nitrogen at somewhere in the neighborhood of 1,000 psi, the nitrogen 65 would be compressed and released during the movement of the subs as will be explained further. The nitrogen 65 within the chamber 67 is maintained therein by O-rings 84, 86 and 93 on the upper and lower ends. As further illustrated in FIG. 4, there is seen an interior tube 90 which is able to move upward and downward within the chamber 67, so as to compress and release the nitrogen as will be explained further. The upper end 92 of tube 90 as illustrated in FIG. 5 where it continues into an upper interior portion 96 as seen in FIG. 5.

Figure 5:
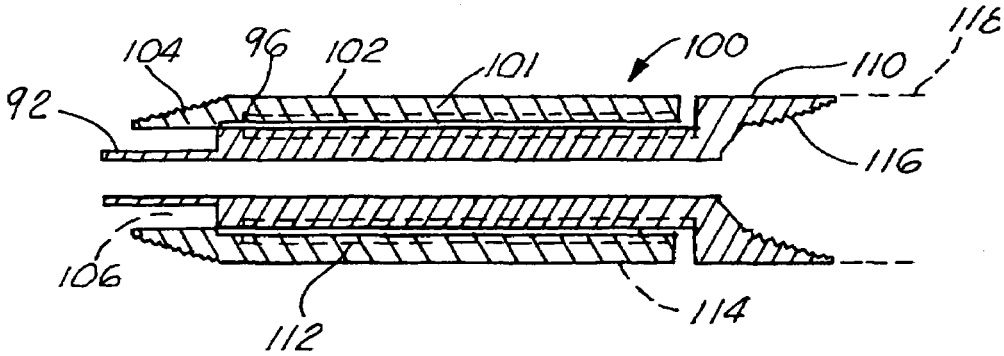
FIG. 5 illustrates the upper spline sub portion of the apparatus of the present invention.

Turning to FIG. 5, FIG. 5 represents the upper spline sub 100. The upper spline sub 100 includes again the uppermost portion 102 of the hammer again which includes an exterior wall having a lower inside male end portion 104 which would threadably engage through upper threaded female end 68 of sub 62. As was stated earlier, likewise, there is a continuous opening 106 within the portion 102, which houses the upper end of the upper spline sub 110 that is housed within the opening 106 in sub 100. The upper spline sub 110 includes a continuous wall portion 112, which is engaged into the wall portion 101 of sub 100 through a series of splines 114 (in phantom view), which allows upward and downward movement of spline sub 110 in relation to portion 102. The uppermost end of spline sub 110 includes a female threaded end portion 116 which is threadably engaged to the lowermost end of a section of pipe or the like which would be illustrated in phantom view as 118 in FIG. 5. This spline sub in combination with spline members 28 in the anvil meter sub provide rotational capability through members 14, 52, 64 and 102.

Having now discussed the component parts as seen in FIGS. 2–5, reference is made to FIGS. 1A–1C and 6—8, for a discussion of the manner in which the entire assembly 10 would operate after it has been assembled into its component parts.

Figure 6:
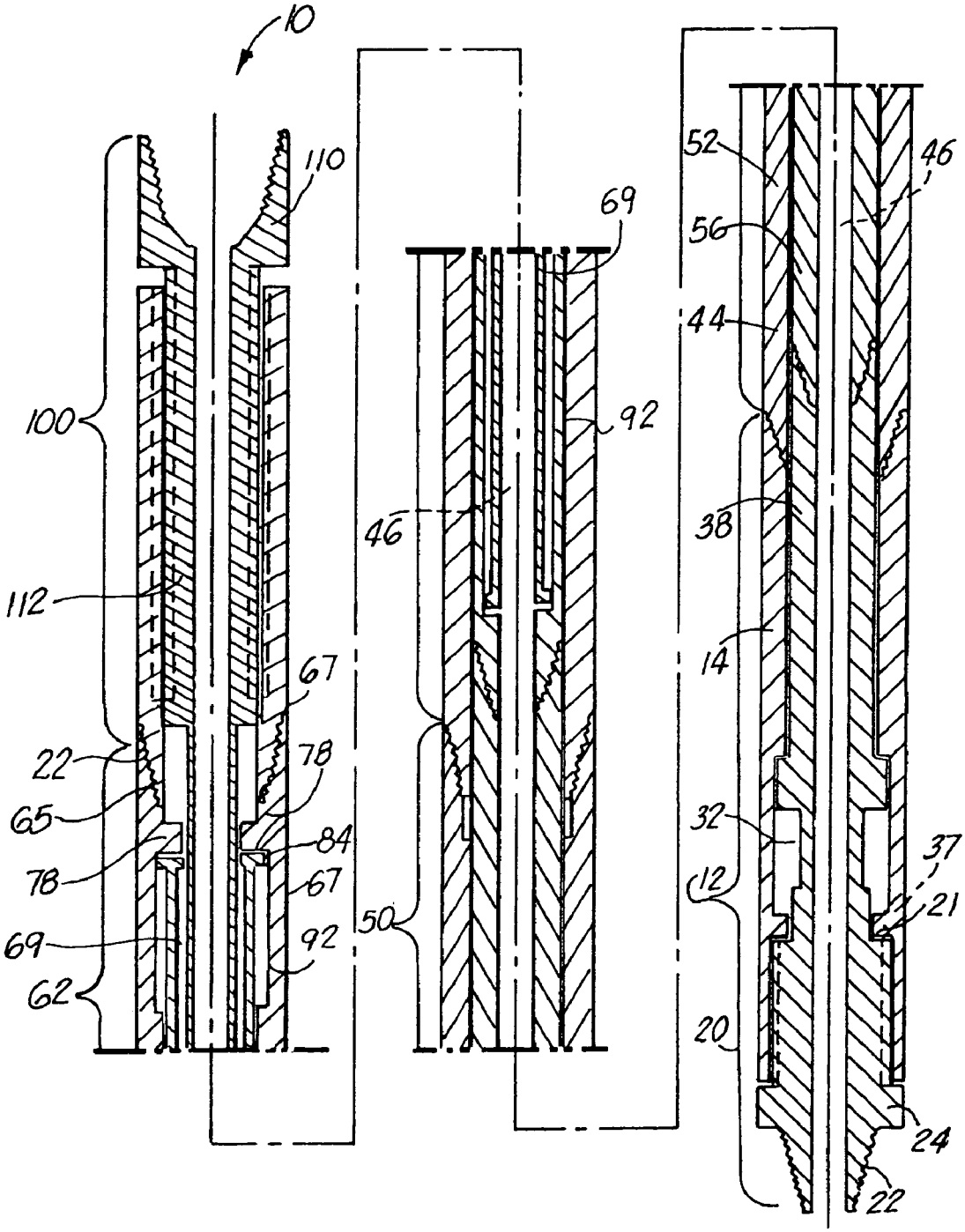
FIG. 6 illustrates the assembled apparatus of the present invention in the first cocked position.
Figures 7A, 7B:
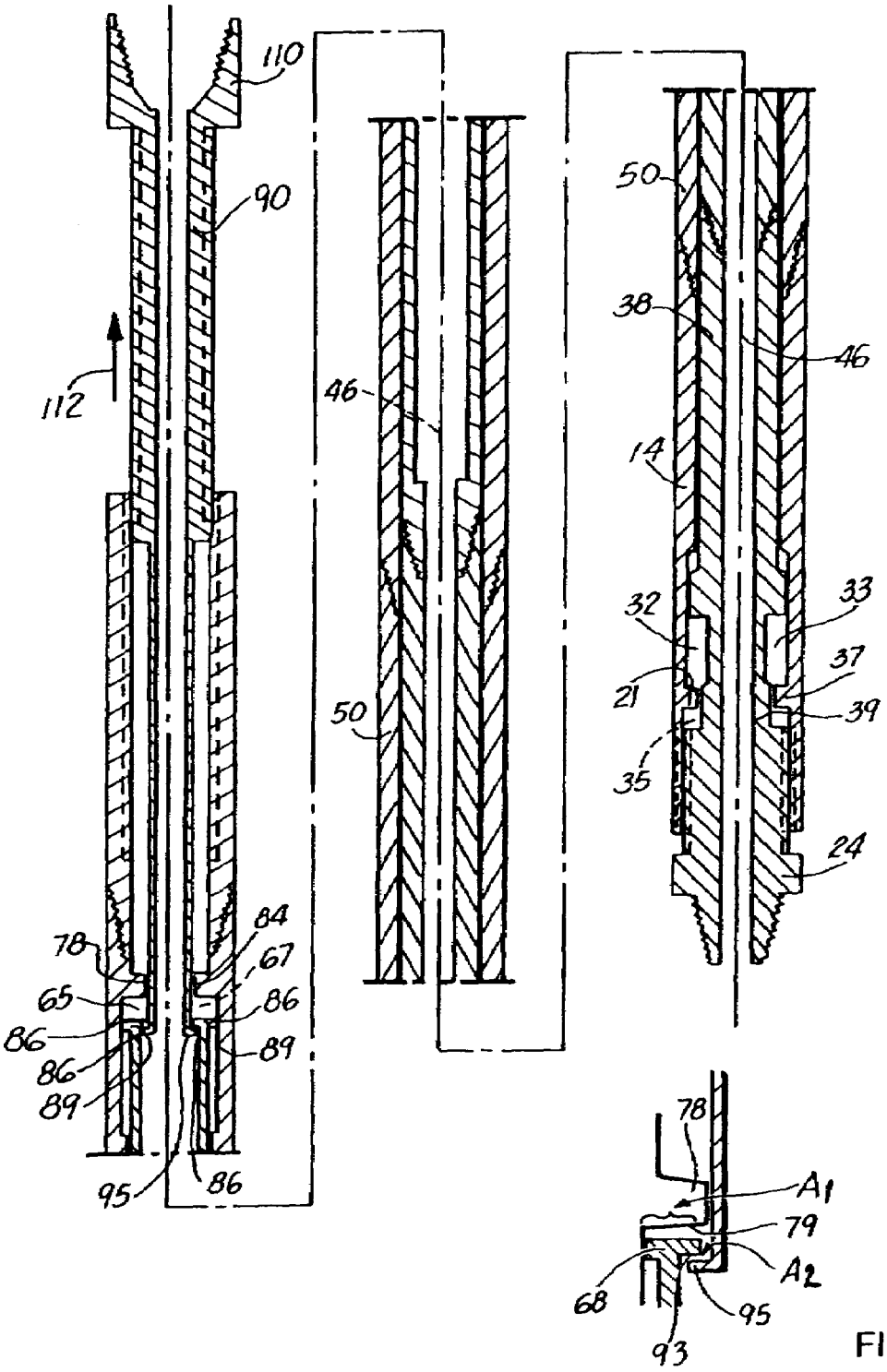
FIGS. 7A and 7B illustrate the assembled apparatus of the present invention in the stroked position, and an isolated view of the differential areas that multiply force, respectively.
Figure 8:
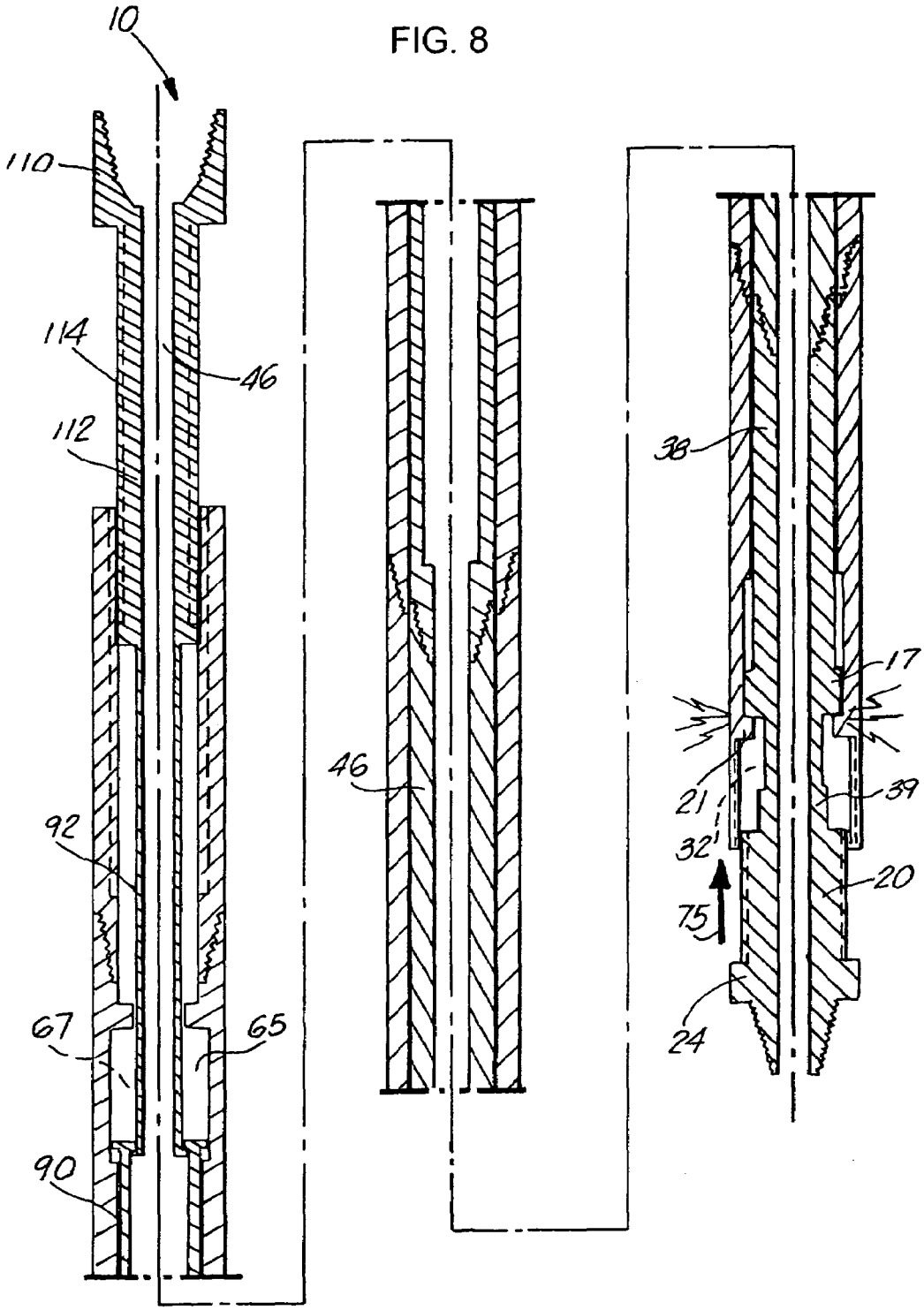
FIG. 8 illustrates the assembled apparatus of the present invention in the firing position.

For purposes of discussion of the FIGS. 1A–1C and 6—8, it should be made clear that FIG. 6 illustrates an exploded view of the entire tool assembly as seen in complete view in FIG. 1A as the tool would be illustrated in the cocked position; while FIG. 7 illustrates an exploded view of the complete tool assembly as illustrated in FIG. 1B in the "energized" position; and while FIG. 8 illustrates an exploded view of the tool assembly as fully illustrated in FIG. 1C in the firing position. A discussion of the operation of the tool will be provided by reference to both the exploded and complete views of the tool in the three positions, namely FIGS. 1A and 6; FIGS. 1B and 7 and FIGS. 1C and 8.

As seen in FIGS. 6 and 1A, the tool assembly 10 illustrating the lowermost anvil and meter sub portion 12 secured on its upper end to hammer and compression sub 50 which is likewise secured on its upper end to multiplier sub member 62 and having at its uppermost end portion upper spline sub 100. As discussed earlier, each of the various sub members would be interconnected to one another via box and pin connections to form the composite assembly 10 as illustrated in the Figures. In the position as seen in FIGS. 6 and 1A, the upper end of upper spline sub 110 would be threadably secured to a section of pipe 118 as seen in the Figures, above the assembly 10, and would be threadably secured on its lower end at pin end 22 to the tool which would be lodged downhole or to a fishing overshot or the like above the tool which would form a continuous connection between the assembly 10 and the tool which is lodged in the hole. As seen in FIGS. 6 and 1A, the assembly is in what is known as the cocked position where the fluid such as nitrogen or the like 65 would be contained within the chamber 67 both above and below the shoulders 78 whereby the nitrogen is basically is in the pre-charged state while the tool is simply cocked in position.

Turning now to FIGS. 7A and 1B, as illustrated in these figures, the interior tube 90 which has an upper spline portion 110, having splines 114, has been lifted upward in the direction of arrows 112 by upward pull on the string above tool assembly 10, and in doing so, has effectively compressed the nitrogen 65 within chamber 67 from the elongated chamber as seen in FIG. 1A to the compressed area 67 as seen in FIG. 1B. Nitrogen 65 is maintained within area 67 by o-rings 84 on shoulder 89, shoulder 78, and shoulder 93. At this point in the discussion reference is made to FIG. 7B which illustrates the concept of the upward force applied being multiplied by virtue of the differential areas A1, defined by surface 79 of shoulder 78, and area A2, which is defined by upper surface 95 of shoulder 89, on interior tube 90. As interior tube 90 is raised to the cocked position as seen in FIG. 7A, the nitrogen 65 is compressed within space 67, the tension force is multiplied by virtue of the differential areas A1 versus A2. The multiplier factor would be represented by the formula:

Multiplier Factor=A2/A1

By virtue of the technique of using differential areas in the multiplier sub the overpull to the jarring apparatus is multiplied by a factor of 1.1 to 15, but in the principal embodiments a value of approximately 5.

In this position, the tool assembly 10 is ready to be fired, and the metering section of the tool has begun operation. Returning to FIG. 1A, the metering space 32 is filled with a metering fluid 34 which would be in the stable state as seen in FIG. 7 and FIG. 1B. After the interior tube 90 has been pulled to the position as seen in FIG. 1B, the outer hammer portion 14 of the assembly begin moving upward slowly as the fluid 34 meters from the large portion of chamber 32, through channel 37, to a smaller chamber portion 35 below shoulder 21 as seen in FIG. 1B.

As seen in FIGS. 8 and 1C, once shoulder 21 has moved passed the enlarged area 39 of tube body 38, the metering is then fully completed, the compressed nitrogen in chamber 67 is allowed to expand very rapidly, which moves the hammer portion 14 with a driving force upward in the direction of arrow 120, whereby the lowermost hammer shoulder 15 makes hard upward contact with the enlarged neck portion 17 of compression tube 20. When this occurs, of course, the entire compression tube 20 is given an upward jolt, which should help to dislodge any tool attached to its lower end at 22. Of course, if a single jolt does not dislodge the stuck took, the interior tube 90 can be returned back to the position as seen in FIGS. 6 and 1A, and the sequences can be repeated until such time that the tool is finally dislodged during the process.

Figure 9:
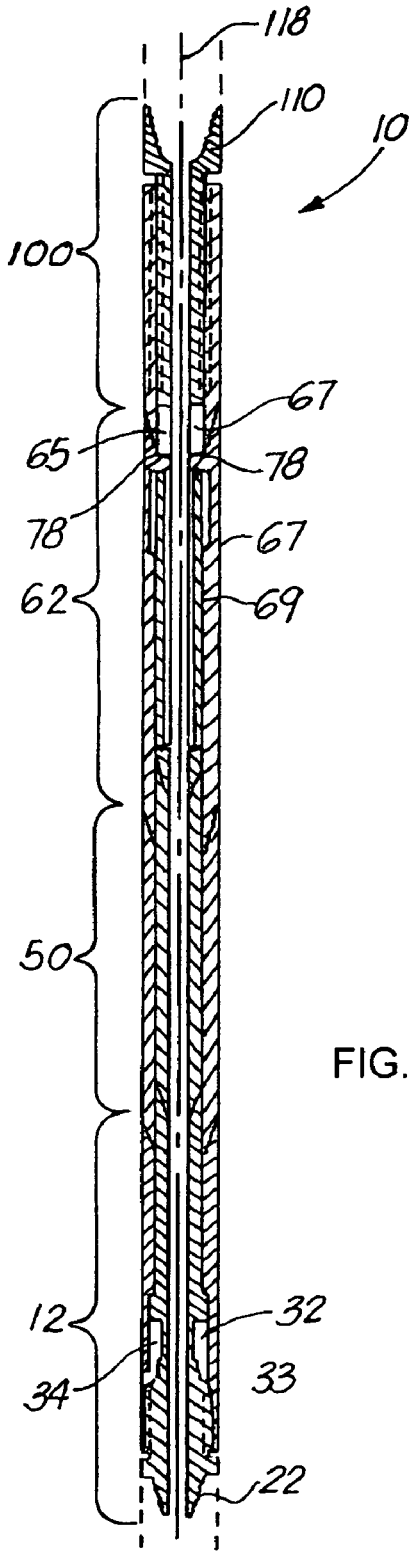
FIGS. 9 and 10 illustrate the invention as depicted in FIGS. 1 and 2.
Figure 10:
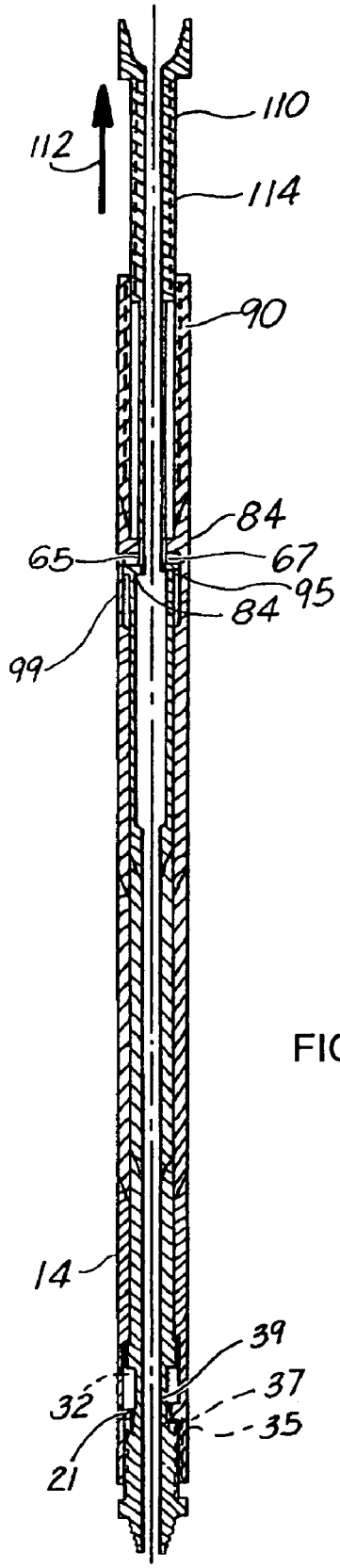
Figure 11:
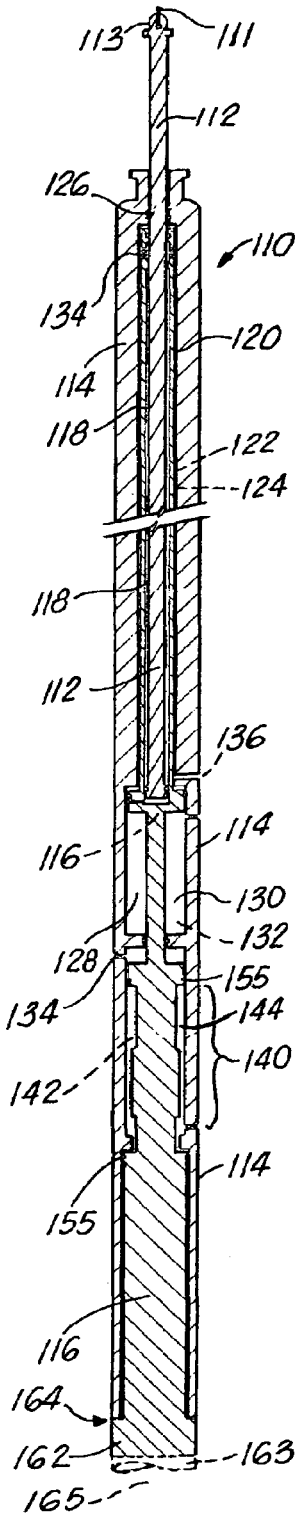
FIG. 11 illustrates an overall cross section view of a second embodiment of the tension multiplying jarring apparatus of the present invention.

FIGS. 9 and 10 are provided to depict the overall apparatus 10 as is illustrated in FIGS. 1 and 2 in the preferred embodiment.

In summary, it should reiterated that the tension multiplier jar apparatus 10 multiplies tension up to a factor of five or above to provide greater over-pull to free stuck objects in the well. This apparatus and system can be used in deviated/horizontal wells where it is difficult to obtain over-pull at the stuck point due to drag. It could be utilized in rig-limited operations where the rig or crane is not capable of providing over-pull, or in coiled tubing or wireline operations where over-pull is limited due to tension limitations. The force multiplied is due to the differential areas acting on a fluid chamber and the lone stroke of 22 or more feet would provide a single stroke in a pumping action or means provided by the multiplier sub. The hammer portion of the apparatus are accelerated by high pressure fluid cushion reacting against the compression tubes that are attached to the stuck object in the well. The upper spline sub provides for rotational capability and transmits rotation to the lower spline and the anvil and meter sub. It is therefore this combination of factors using the apparatus and method of the present invention that the system of dislodging tools is carried out in the preferred embodiment.

In an additional principal embodiment, the tension multiplying process can also be applied to a wireline operation as will be discussed herein in reference to FIGS. 11 through 15D.

In summary, what is provided is an apparatus which may be used at the end of a slick line application or other application, in the neighborhood of 5,000 psi hydrostatic environment within a bore hole, the apparatus comprising a first piston rod; a second external housing; and an internal shaft within the apparatus. There is provided a first fluid chamber which would be typically filled with nitrogen or other compressible fluid that is used to energize the up jar operation of the apparatus, which is formed by an annulus between the piston rod and shaft, and a secondary (dead) annulus formed by the internal shaft and external housing. There is provided a lower means which comprise a fluid chamber typically filled with nitrogen or other compressible fluid used to energize the downward jarring operation, which would be formed by the annulus between internal shaft and the outer housing. There would be a third or metering section also utilizing a fluid such as nitrogen or other compressible fluid which would be used to delay the movement of the jarring components, so that sufficient energy can be built up in the tool, this section formed by the annular space between the internal shaft and the external housing.

Making reference to the Figures, in the tension multiplying jarring method and apparatus 110 of the present invention, it is foreseen that the apparatus would be used in combination with slick line 111, preferably a 2 ¼" OD, operating preferably in approximately 5,000 psi hydrostatic environment down a bore hole. The apparatus 110 for carrying out the tension multiplying jarring method would include three basic moving components, i.e., a piston rod 112, an external housing 114, surrounding the piston rod 112, and an internal shaft 116 therein. There would further be provided an upper energizing means, which would comprise a fluid chamber 118 typically filled with nitrogen or other compressible fluid 120, that is used to energize the up jar operation of the apparatus 110. This chamber 118 would be formed by an annulus 122 between the piston rod 112 and the shaft 116. There is further formed a secondary (dead) annulus 124 between the internal shaft 116 and the external housing 114. The fluid chamber would be sealed by O-rings 126, and would be delivered into the chamber 118 for operation. There would be included a separate fill port 125 for filling the first fluid 120 into the chamber 118 of apparatus 110.

There would further be provided a second lower energizing means which would include a second fluid chamber 128 typically filled with nitrogen 130 or other equivalent compressible fluid, used to energize the downward jarring operation of the apparatus 110. This particular fluid 130 in the second fluid chamber 128 would be formed by the annulus 132 between the internal shaft 116 and the outer or external housing 114. Like the first fluid chamber 118, second fluid chamber 128 would also be sealed off by O-rings 134 so as to maintain the fluid 130 within the chamber 128 and would also include a separate fill port 136 for filling this second fluid 130 into the chamber 128 of apparatus 110, and an exhaust port 137 for exhausting fluid. There would be included a metering section 140 which would include a metering chamber 142, which would be filled with a metering fluid 144. This metering section 140 can be formed by the annular space 148 between the internal shaft 116 and the outer housing 114. Also this third chamber 140 would be sealed off by O-rings 155 for maintaining the fluid 144 within the chamber 142 and would include a fill port 150 and an equalizing valve 152 for equalizing the pressure within the chamber 142.

Reference is now made to the Figures for the explanation of the operation of the apparatus for the present invention. As illustrated in FIGS. 12A–12D, there is illustrated the apparatus 110 latched to a fish or plug 163, which would be lodged within the bore hole 165 and would provide firm resistance to either upward or downward tension. Once the apparatus 110 has been latched to the lodged plug 163 in a conventional manner known in the art, the first upper chamber 118 of the apparatus 110 would be charged with fluid 120 up to 2,650 psi, which would be a preferable charging amount; although the pressure could be less or more depending on the circumstances. The second lower fluid chamber 128 would likewise be charged to 2,925 psi, or more or less depending on the situation. Due to the unresolved force on the upper portion 113 of the piston rod 112, an initial tension of 460 lbs. of pressure would be applied to apparatus 110 with no movement of the piston rod 112.

Turning now to FIGS. 13A–13D, there would be illustrated an over pull of 750 lbs. as applied to the tool via the slick line 111 moving the piston rod 12 a total of 15' in an upward stroke as seen by arrow 115. In doing so, the pressure in the first fluid chamber 118 would increase to 4,970 psi due to a 1:9.1 volume reduction. Likewise, the pressure in the second fluid chamber 128 would decrease to 530 psi due to a 1:5.5 volume increase. The upper portion 117 housing 114 will have a 7,550 lb. upward force applied to it due to the upper chamber pressure acting on areas A1 and A2 lest a downward force due to the lower chamber pressure acting on area A3. The fluid 144 in the metering chamber 142 would delay the movement from the apparatus 110 in its downward jarring operation, as seen in FIGS. 13A–13D, to allow the operator to pull the 15' of stroke on piston rod 112 as was discussed earlier. This would provide a 10 to 1 tension multiple on the jarring force of the apparatus 110.

Turning now to FIGS. 4A and 4D, as the outer housing 114 of the apparatus 110 slowly progresses upward, fluid 144 in metering chamber 142 is metered out of the small bypass area 145 until the unobstructed bypass zone 147 is obtained allowing free movement of the outer housing 114. The upper hammer 149 on the outer housing 114 would contact the upper anvil 151 on the internal shaft 116 providing an upward energizing jarring force, as seen by contact point 153. After the tool jars, the pressure in the upper first chamber 118 would reduce to 3,950 psi, while on the second lower chamber 128 the pressure increases to 600 psi. The tension on the piston rod 112 is reduced to 595 lbs., giving a clear indicator to the operator at surface that the apparatus 110 has actuated.

Figure 15A:
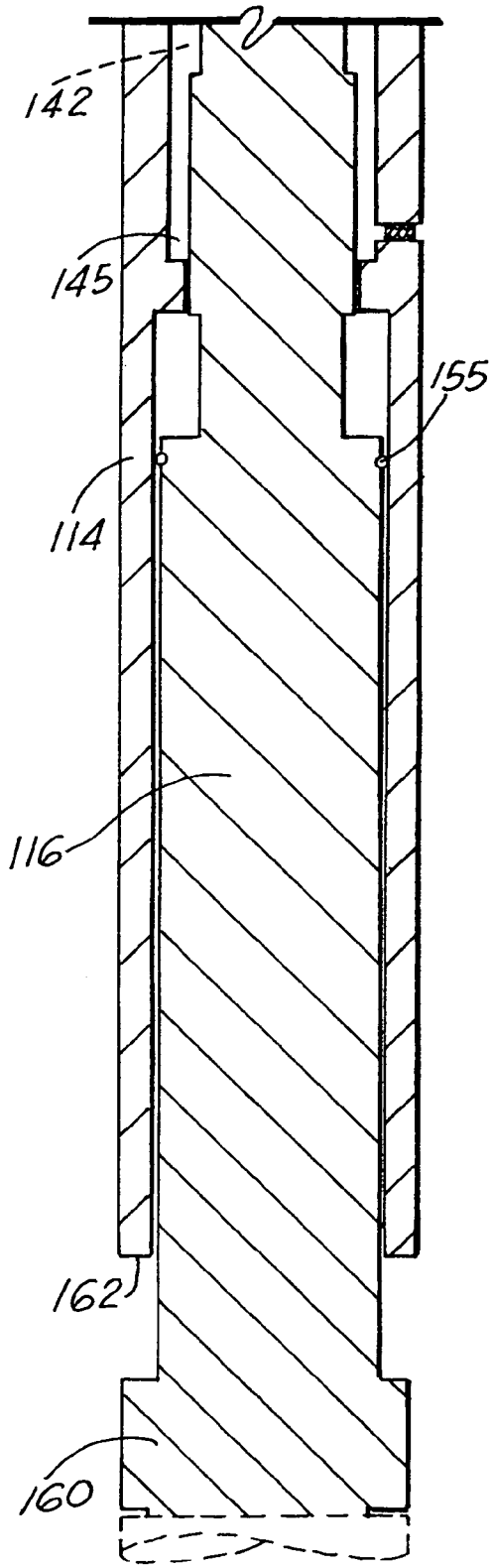
FIGS. 15A–15D illustrates section views through the apparatus in the energized down jarring position.
Figure 14B:
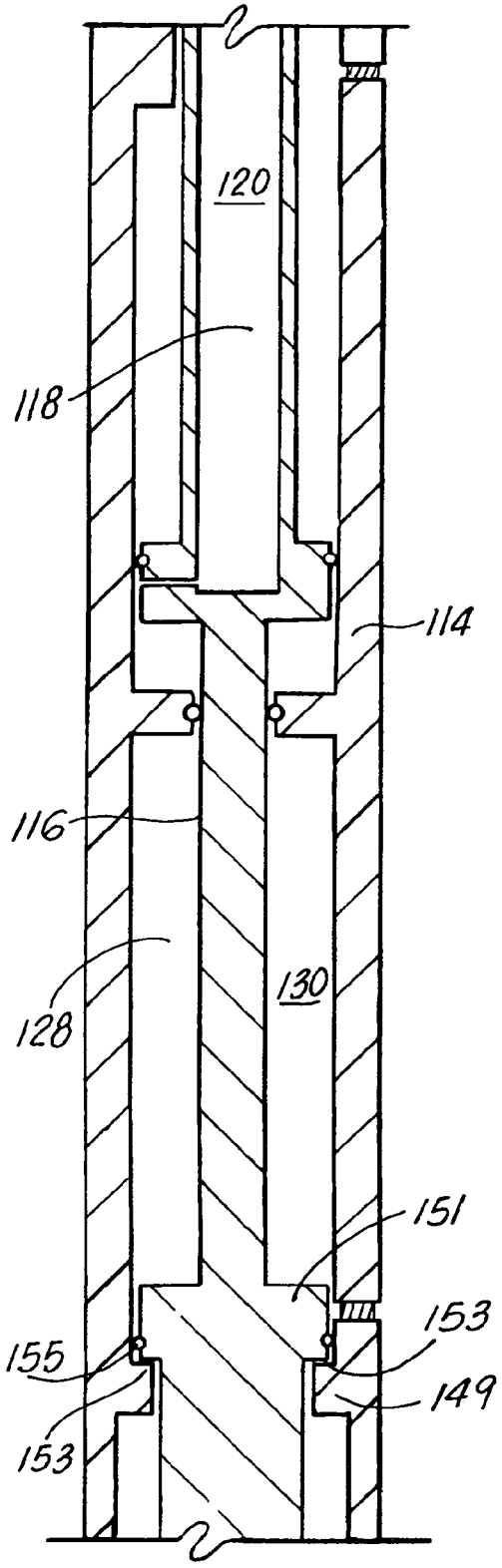
Figure 15B:
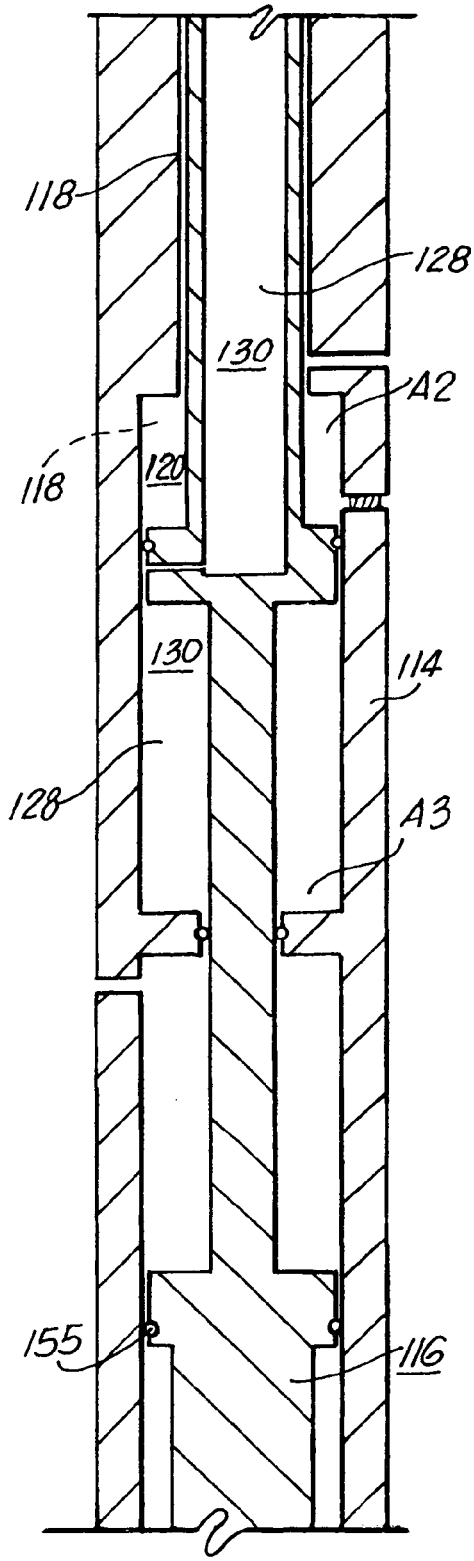
Figure 14C:
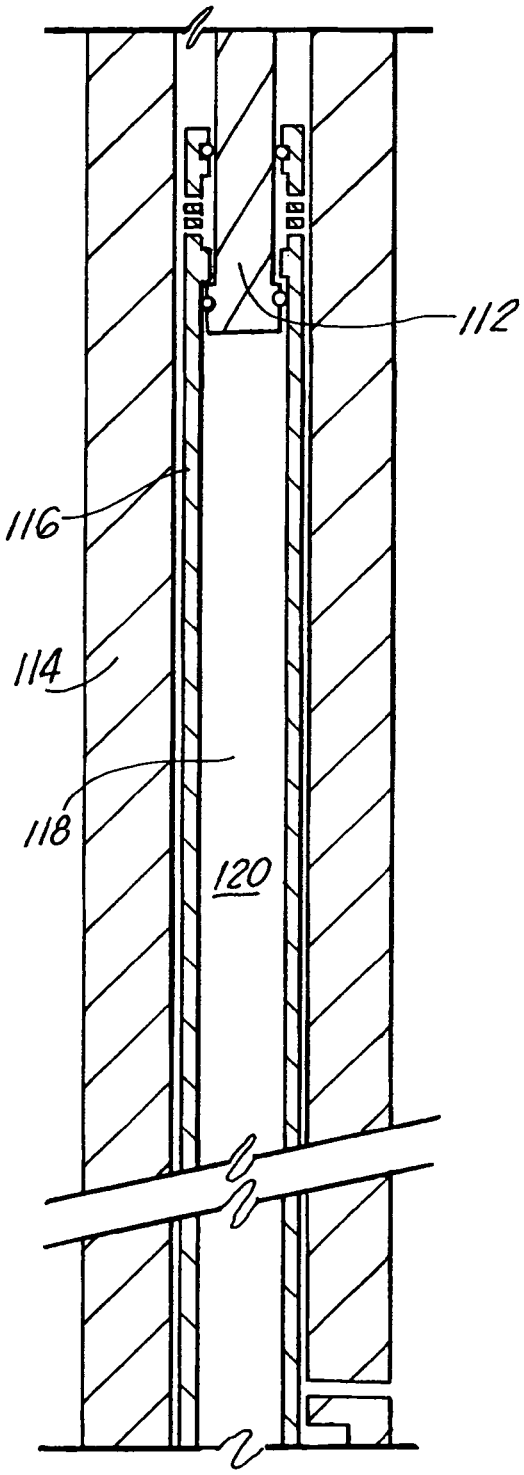
Figure 15C:
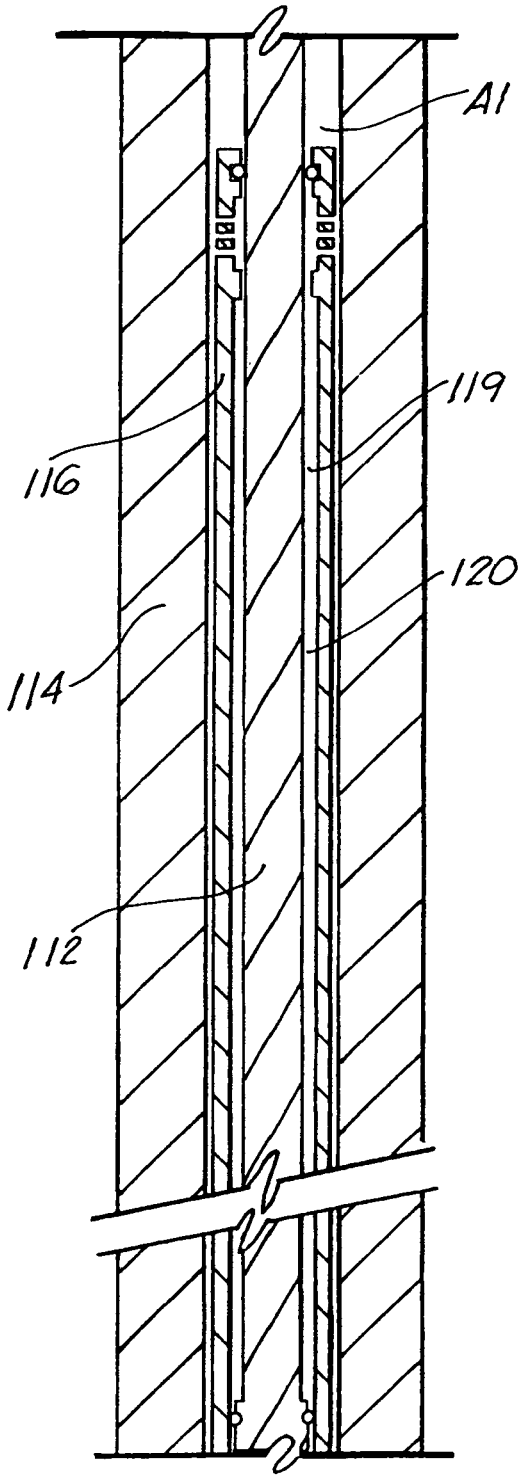
Figure 14D:
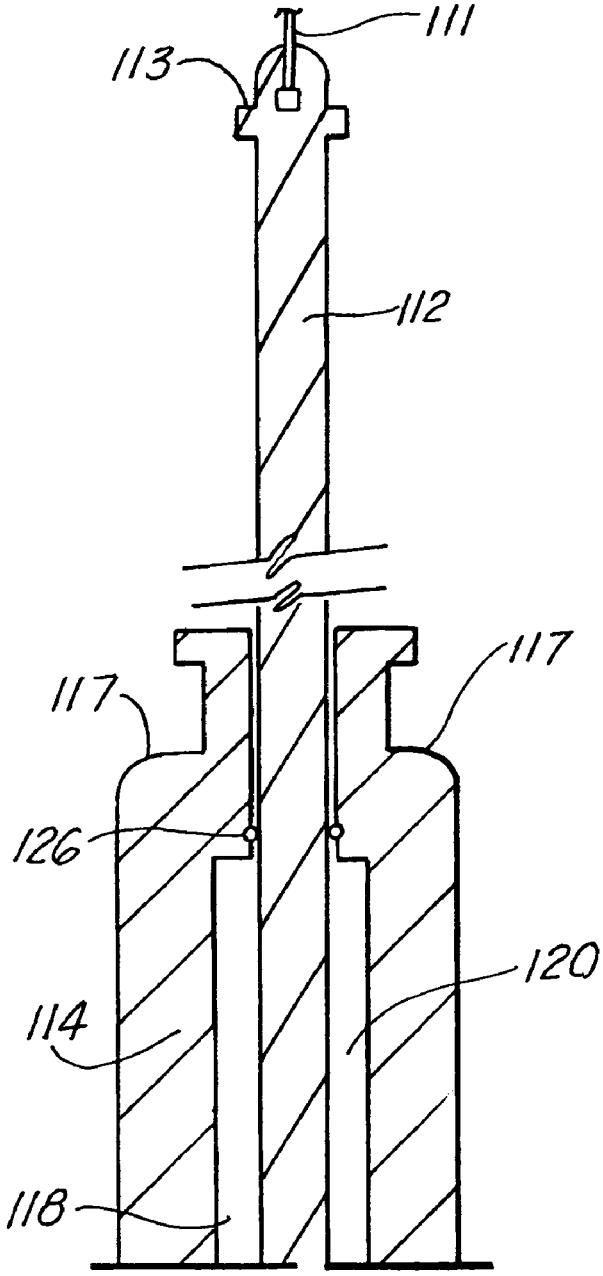
Figure 15D:
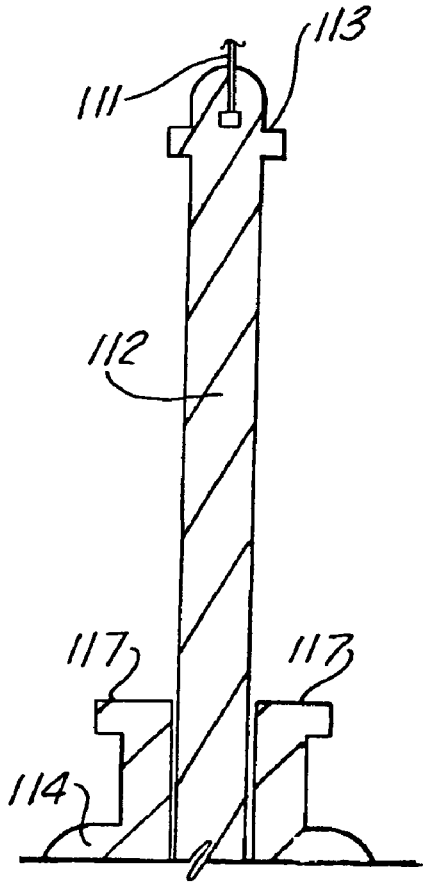

Turning now to FIGS. 15A and 15D, there is seen the apparatus 110 energized "down" in its operation. At this point the operator slacks off 15' allowing the piston rod 112 to move back to its original position. Pressure in the first upper chamber 118 will reduce to 2,375 psi, while the pressure in the second lower chamber 128 will increase to 3,790 psi. A total downward force of 2,400 lbs. would be applied to the outer housing 114 due to the second lower chamber 128 applying pressure to area A3 lest the upward force applied by the pressure in the first upper chamber 118 to areas A1 and A2. The metering chamber 142 would restrain the movement of the tool due to the reduced area.

Figures 12, 13, 14, 15:
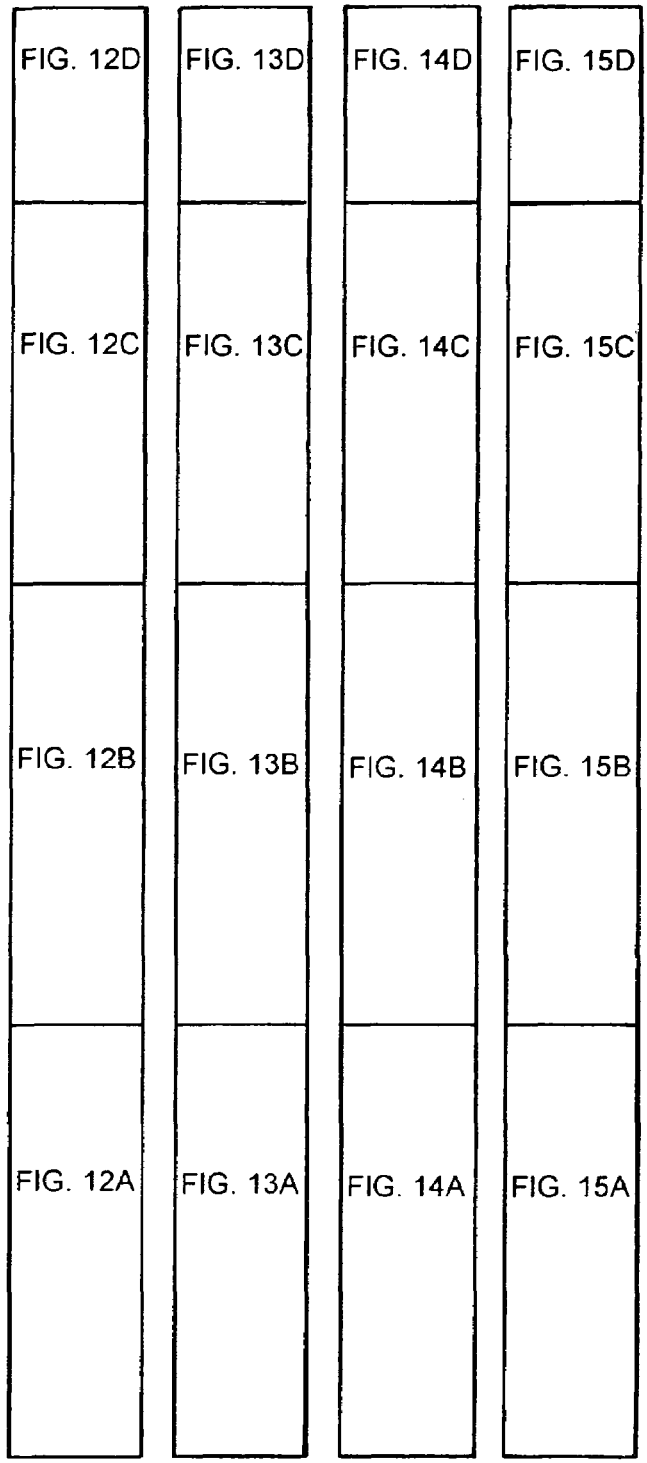
FIGS. 12 through 15 illustrate in representational form FIGS. 12A–12D, 13A–13D, 14A–14D and 15A–15D respectively.
Figure 12A:
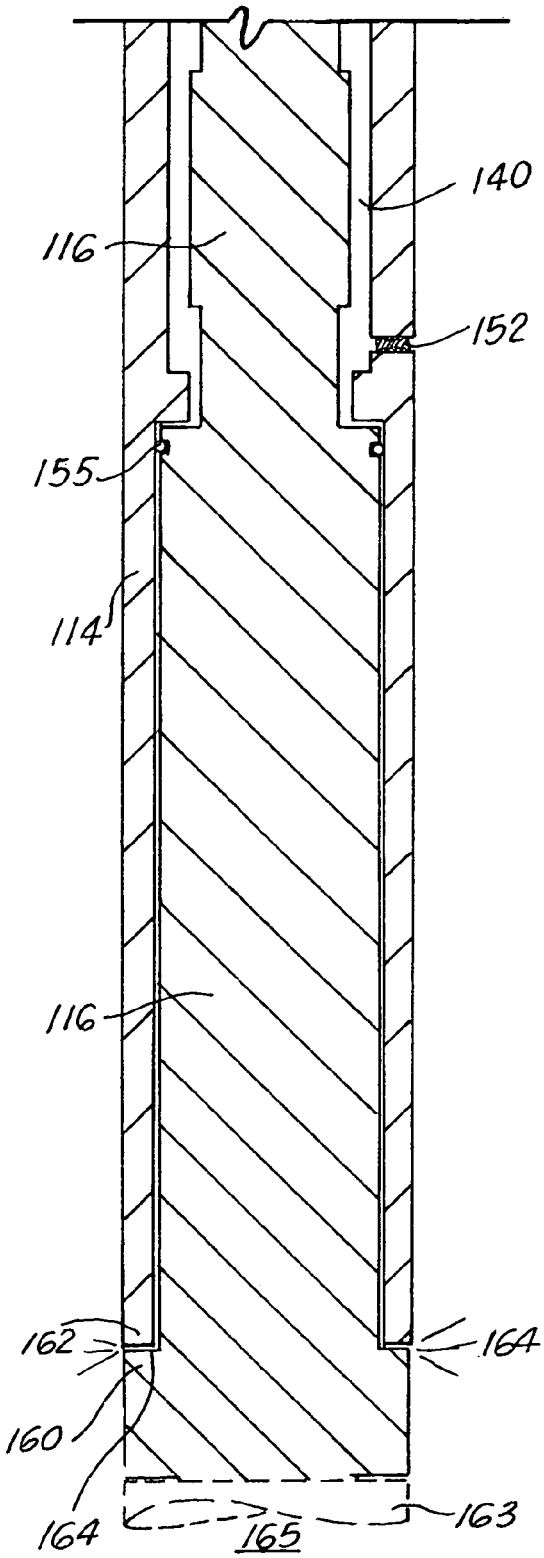
FIGS. 12A–12D illustrates section views through the apparatus in the cocked or down jarring position.
Figure 13A:
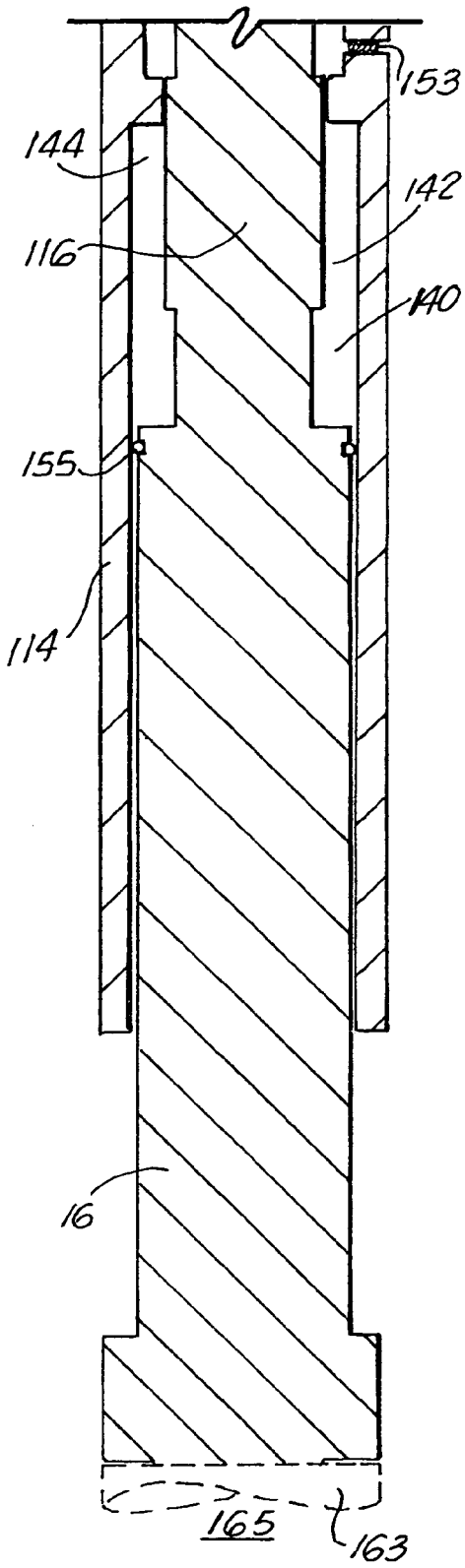
FIGS. 13A–13D illustrates sections through the apparatus in the energized up position.
Figure 12B:
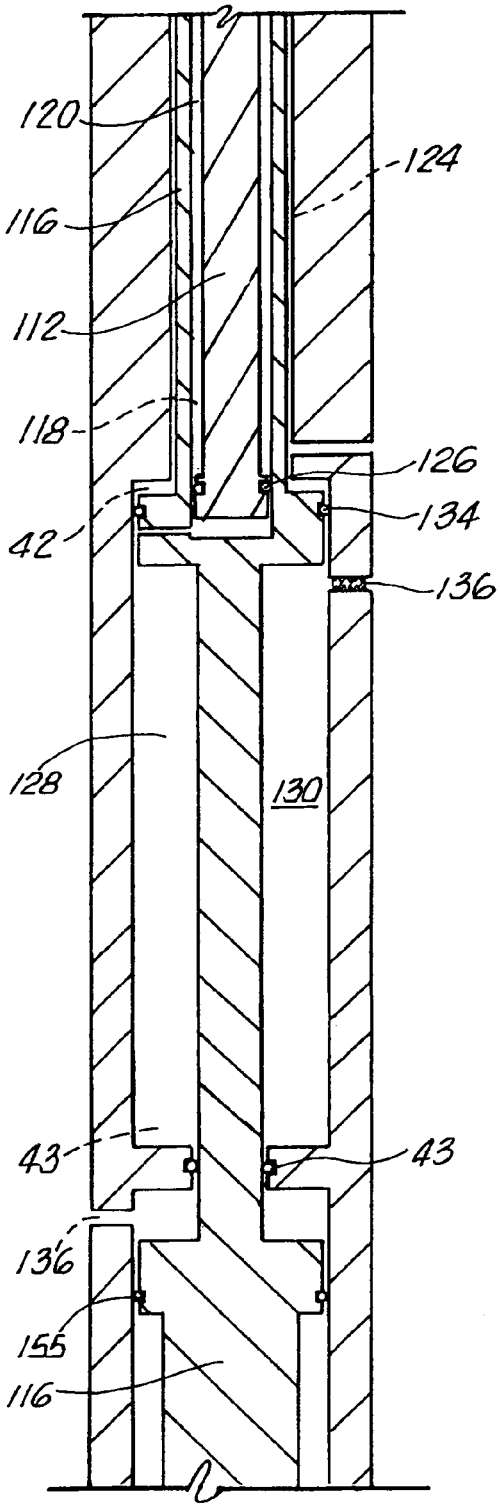
Figure 13B:
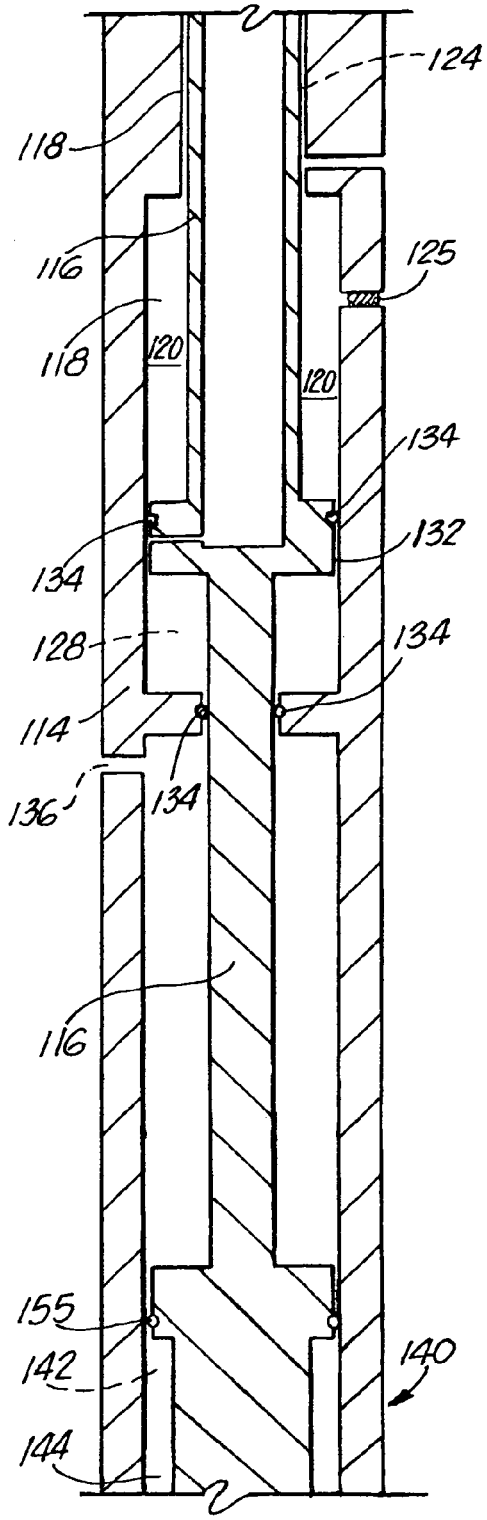
Figure 12C:
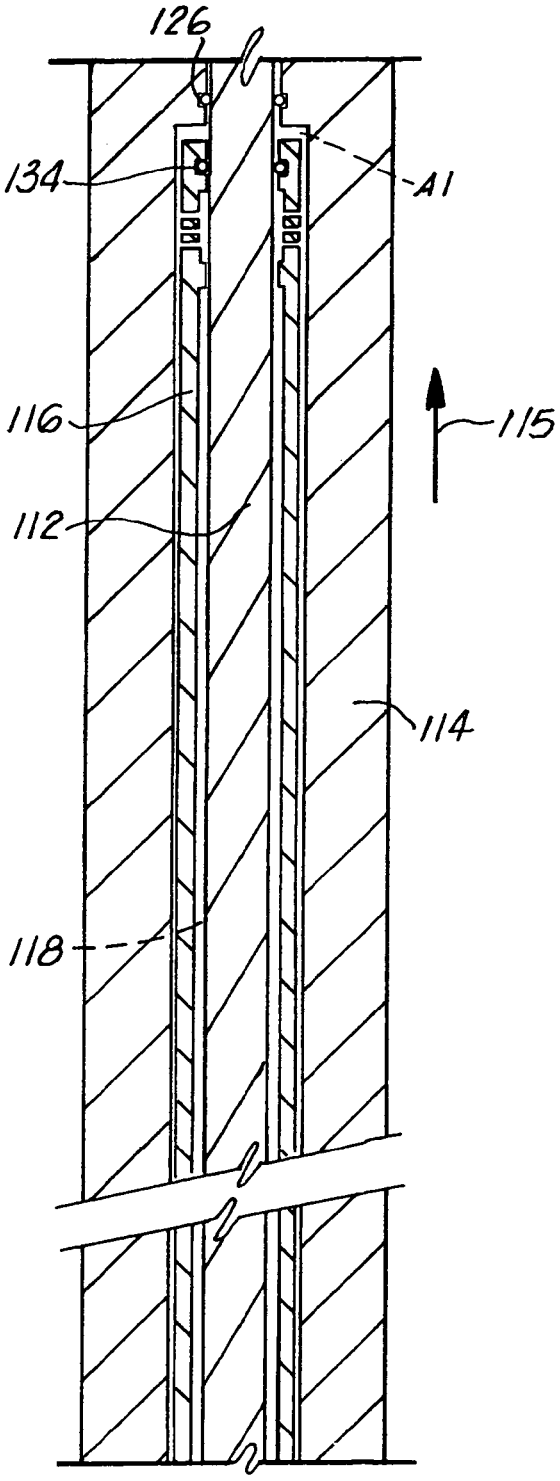
Figure 13C:
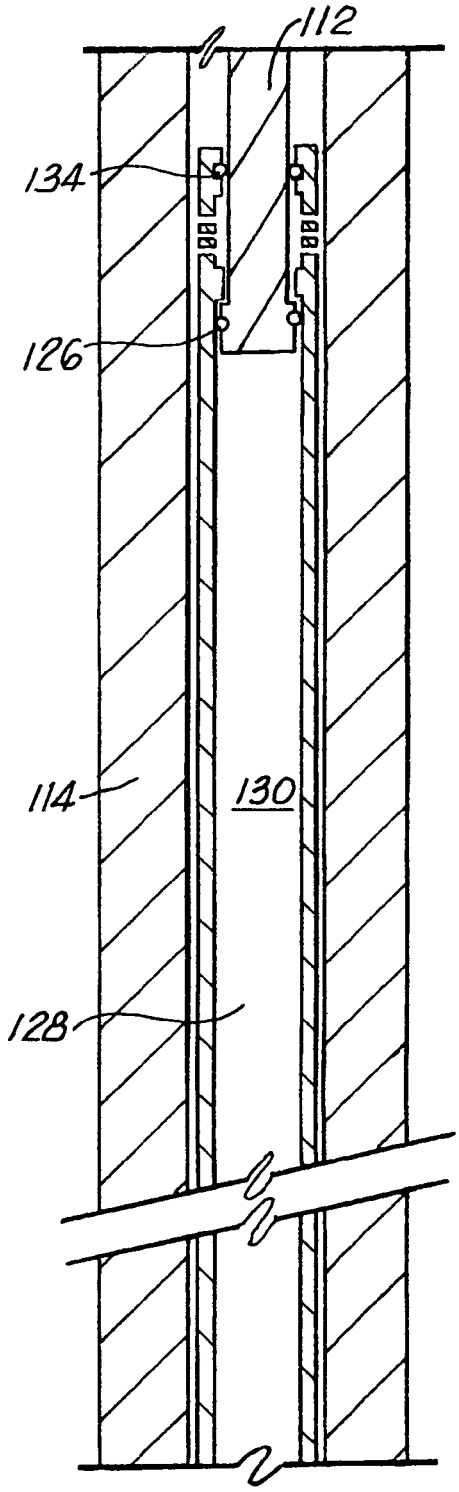
Figure 12D:
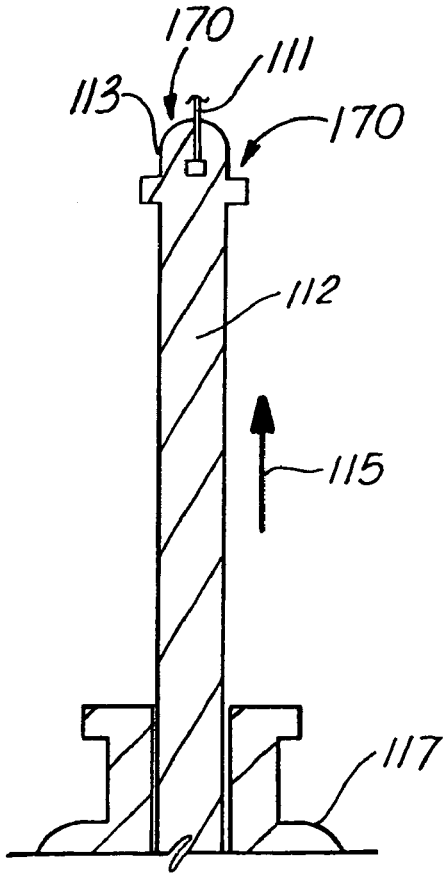
Figure 13D:
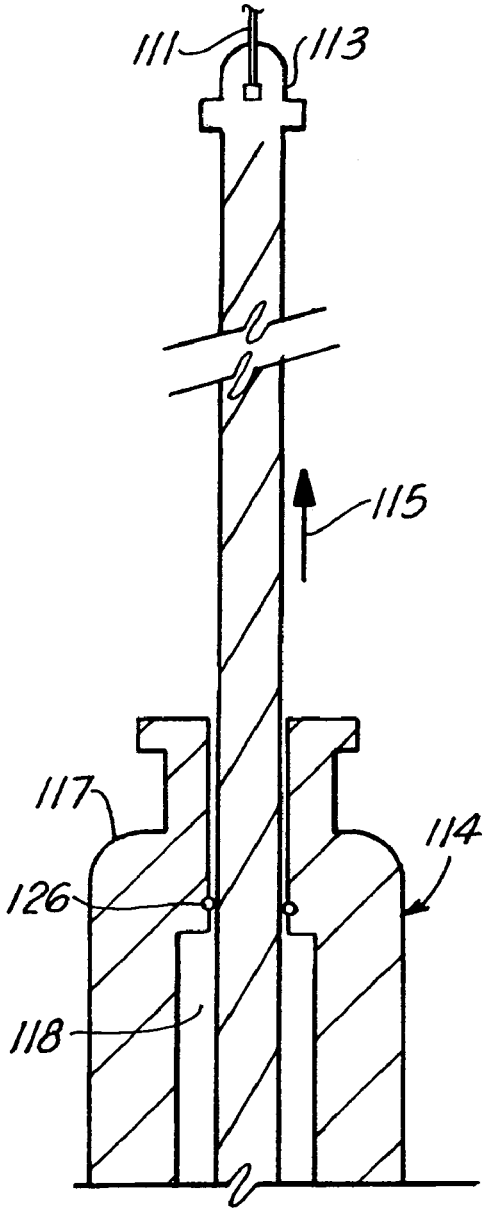
Figure 14A:
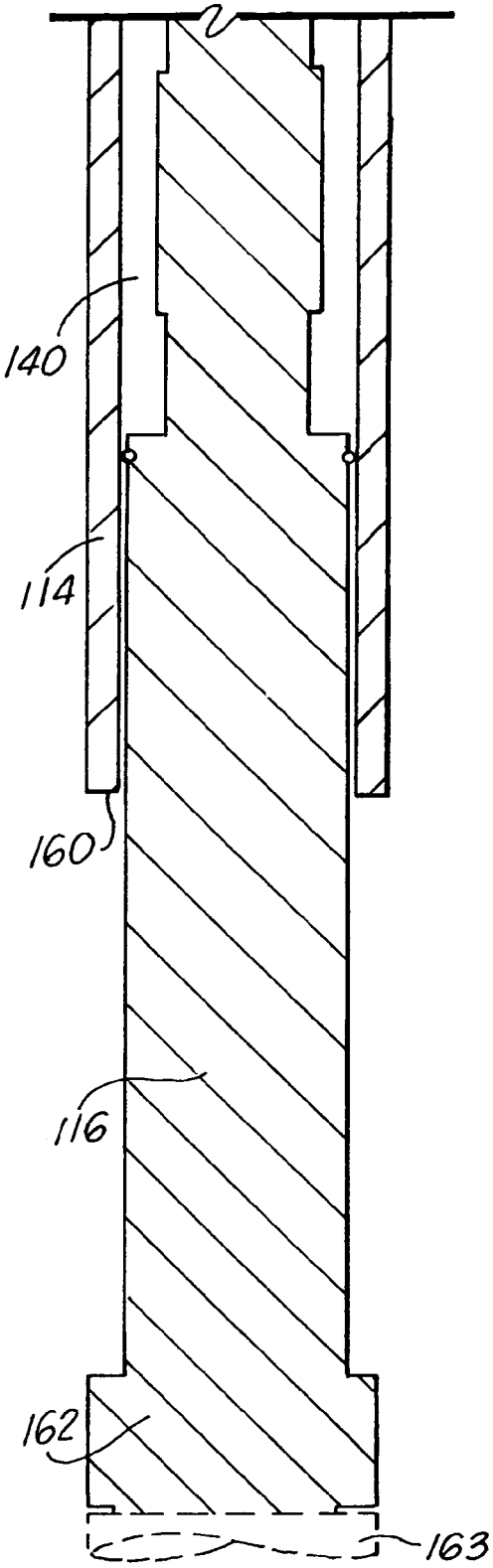
FIGS. 14A–14D illustrates sections through the apparatus in the up jarring positions.

Turning now to FIGS. 12A and 12D, as was discussed earlier the metering fluid 144 in metering chamber 142 has bypassed the reduced area 145 allowing the unobstructed downward movement of the tool. The jar would deliver an energized downward blow at the bottom of the apparatus 110 as the lower hammer 160 on the external housing 114 contacts the lower anvil 162 on the internal shaft 116 at contact point 164. This downward blow would be assisted by the hydrostatic pressure in the well (around 5000 psi) acting on the upper portion 113 of the piston rod 112 seen by arrows 170 in FIG. 12D, which would increase the downward impact when the lower hammer 160 of the internal shaft 116 strikes the lower anvil 162 of the external housing 114.

FIGS. 16A–16F illustrate yet an additional embodiment of the present invention under numeral 210. In summary, this embodiment, referred to as a coil-tubing or slickline embodiment, would utilize a hybrid spring system incorporating an incompressible fluid energizing a set of Belleville springs. This tool is hydrostatically balanced, i.e., can be run to any depth or pressure without presetting a gas charge or "dome." Options include a compensated nitrogen "dome" in lieu of the Belleville springs, a mechanical latching mechanism (versus a hydraulic metering system), and a gas filled nitrogen return spring system. Additional weight items can be added to the top of the tool, if desired.

Figure 16A:
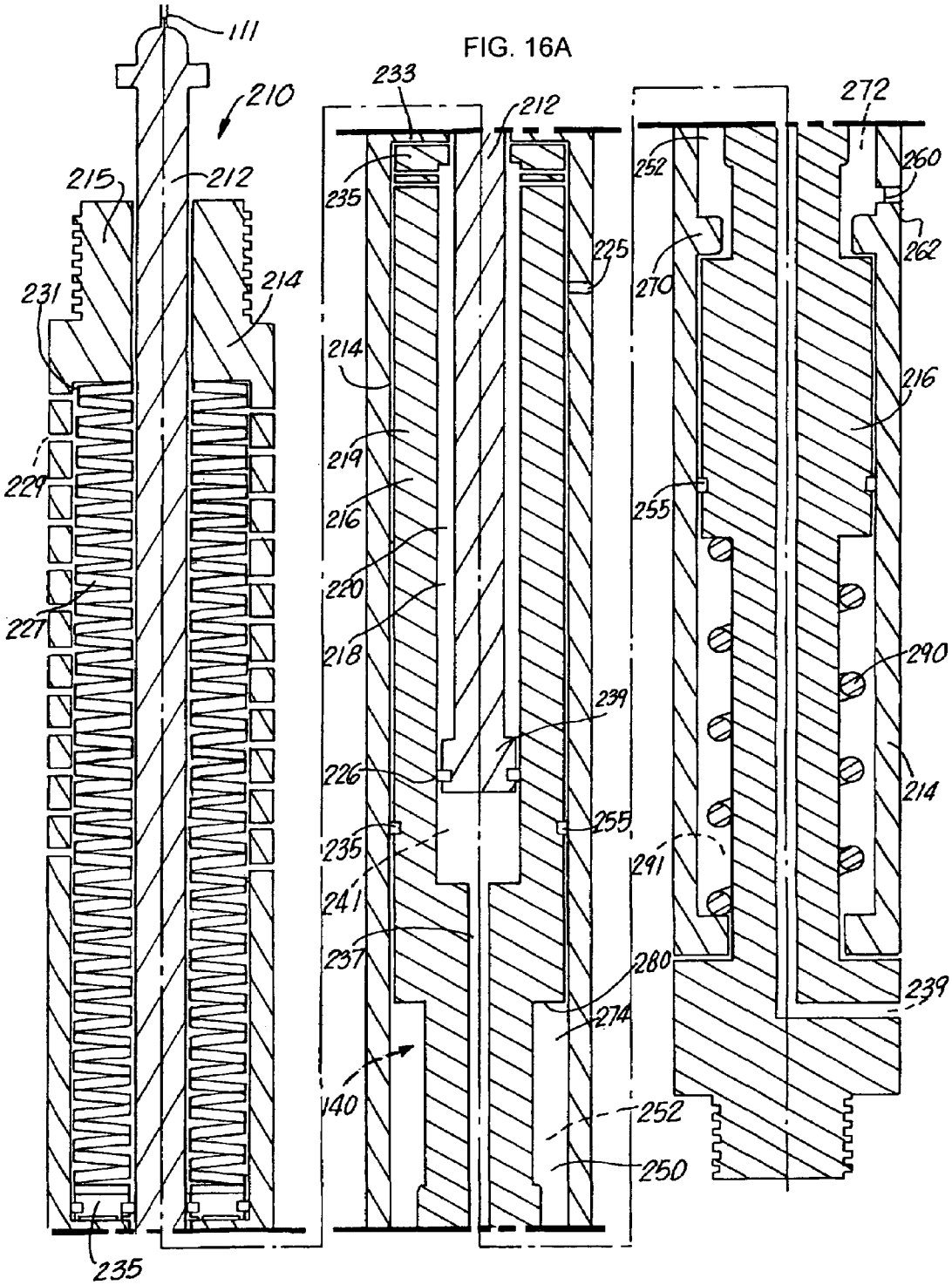
FIGS. 16A through 16F illustrate cross sectional views of a third embodiment of the apparatus of the present invention.

As with the earlier embodiments as discussed in FIGS. 1–15D, the operation of the tension multiplying jarring method and apparatus 210 of the present invention is quite similar to the earlier embodiments as discussed. In general, as illustrated in FIG. 16A, this particular embodiment of the apparatus 210 would be extending from a slickline 111 of the type identified earlier. The apparatus 210 like the apparatus 110 in the earlier embodiments would also include a piston rod 212 an external housing 214 surrounding the piston rod 212 and an internal housing 216 the function as will be identified later. The principal difference between this embodiment and earlier embodiments is the fact that there is provided a plurality of Belleville springs 227 which are included in the space between the piston rod 212 and the outer wall of the outer housing 214. Belleville springs are well known in the art and in this capacity they are serving as a means to energize the tool during the operation of the apparatus. There is further provided a plurality of ports 229 in the wall of the body housing the Belleville springs 227 which are used to maintain the hydrostatic pressure within the tool 210 similar to the hydrostatic pressure outside the tool. The Belleville springs 227 are held in place at the upper shoulder 231 of the upper portion of the body 214 and a lower internal shoulder 233 the lower portion of the Belleville springs 227 include an upper piston member 235. The internal housing 216 would include an internal port 237 which would extend to an outer opening 239 in the lower wall in the internal housing 216 to maintain the hydrostatic pressure within the chamber 241, housing the lower end of the rod 212. In this manner, the hydrostatic pressures are balanced against the lower piston 239 via ports 229. Therefore, unlike the other embodiments, the energizing means are the Belleville springs 227, which are compressed by the movement of the lower piston 239 and the incompressible fluid 218 within chamber 220. As with the earlier embodiments, there would also be included a metering section 250 which would include a metering chamber 252 which would be filled with a metering fluid 254. This metering section 250 would be formed between the internal housing 216 and the outer housing 214, and would operate in the same manner as discussed in relation to the earlier embodiments. Also this metering section or chamber 250 would be sealed off by o-rings 255 for maintaining the metering fluid 254 within the chamber 252 and would include a fill port 260 and an equalizing valve 262 for equalizing the pressure within chamber 252 as is well known in the art.

In operation, as with the earlier embodiments, when an upward force is placed upon the rod 212, the lower piston 239 would pressurize the incompressible fluid 218 within chamber 220 and this force would cause the outer housing 214 to begin to lift as the fluid pressurizes the upper piston 235, which would then compress the Belleville springs 227. As this is happening, as with the earlier embodiments, the lower shoulder 270 on the outer housing 214 would move slowly into the metering area 272 so that when the shoulder passed into the upper fluid portion 274 of the metering section 250, the outer housing 214 would be projected upward forced by the Belleville springs 227 so that the shoulder 270 would make jarring contact with the lower anvil portion 280 of the internal shaft.

In this embodiment, there is further included a helical spring 290 set within a chamber 291 at the lower end of the housing positioned between the internal housing 216 and the outer housing 214 so that when firing has occurred and the fluids have been normalized, the helical spring 290 would return the outer housing to its position as seen in FIG. 16A. Again the difference between this embodiment primarily is the fact that there is included the Belleville springs 227 as the upper energizing means unlike the other earlier embodiments.

Figure 16B:
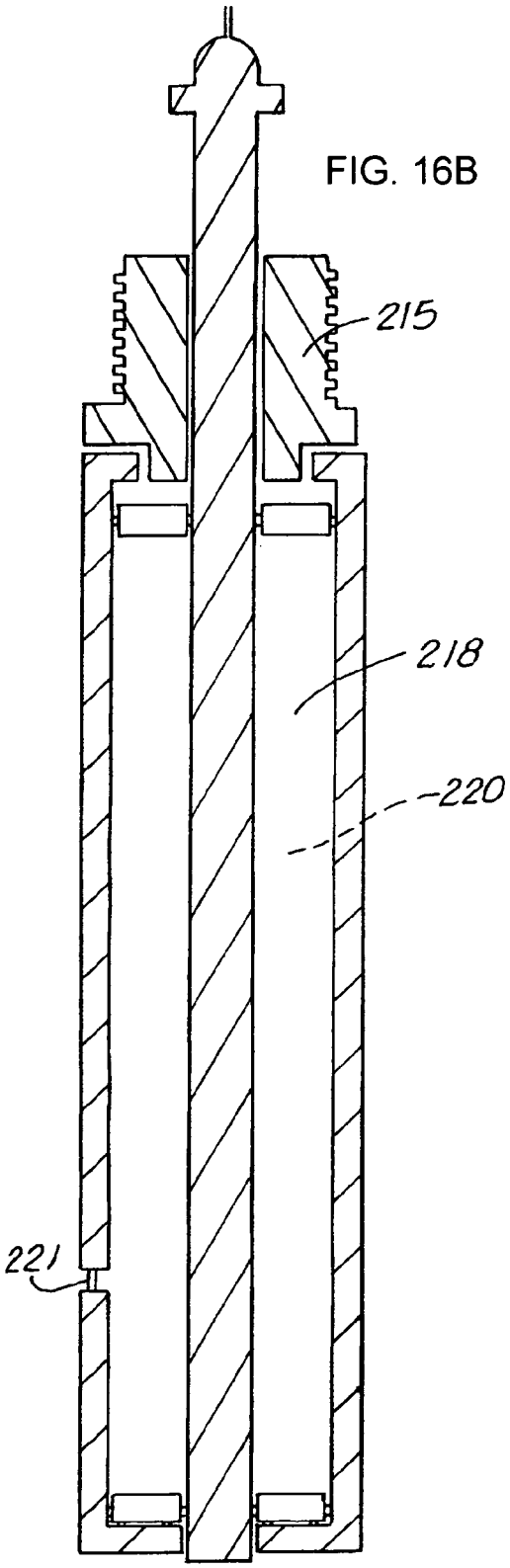

FIG. 16B simply illustrates a portion of the tool wherein rather than incorporate the Belleville springs 227 within the upper portion as illustrated in FIG. 16A, there would be a nitrogen spring section, which in effect would be filled with nitrogen 218 within the chamber 220 to serve as the energizing means to the tool. There would be a rupture disk 221 to compensate for any over pressurizing of the nitrogen. This simply would act as a separate pressurizing means in the same manner as the Belleville springs except that there would be compressed gas in the chamber rather than a compressible mechanical item.

Figure 16C:
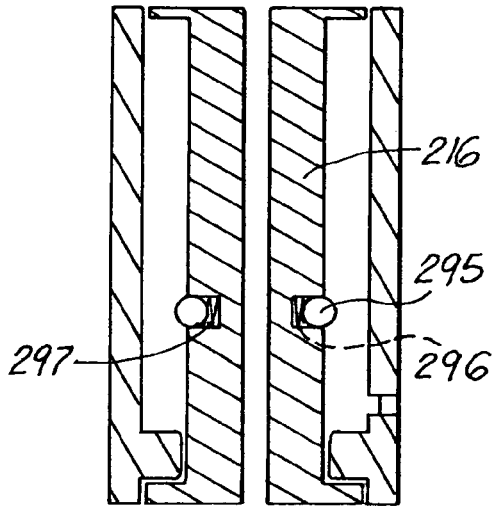
Figure 16D:
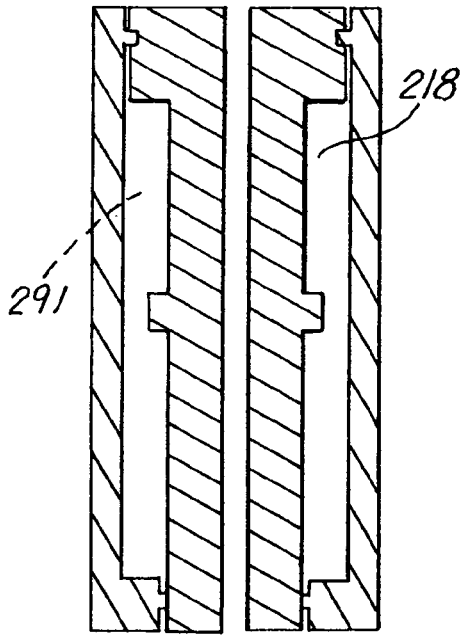

FIG. 16C illustrates a mechanical latching feature which would be used to maintain the tool locked in place, which would include a ball member 295 positioned within an opening 296 in the wall of the internal shaft 216. The ball would be normally extending outward via a spring 297 so as the shaft moved upward past the metering section it would simply be pushed inward against the force of the spring 297. FIG. 16D illustrates an alternative spring for resetting the tool rather than the helical spring 290 as was discussed earlier. Again, rather than the spring 290 being housed in the chamber 291, as discussed in FIG. 16A, there would be an alternative nitrogen spring 293 wherein the nitrogen 293 would be in the opening/chamber 291 to be compressed during energizing. After the tool is fired, the nitrogen spring 293 would expand to return the tool for the next firing.

Figure 16E:
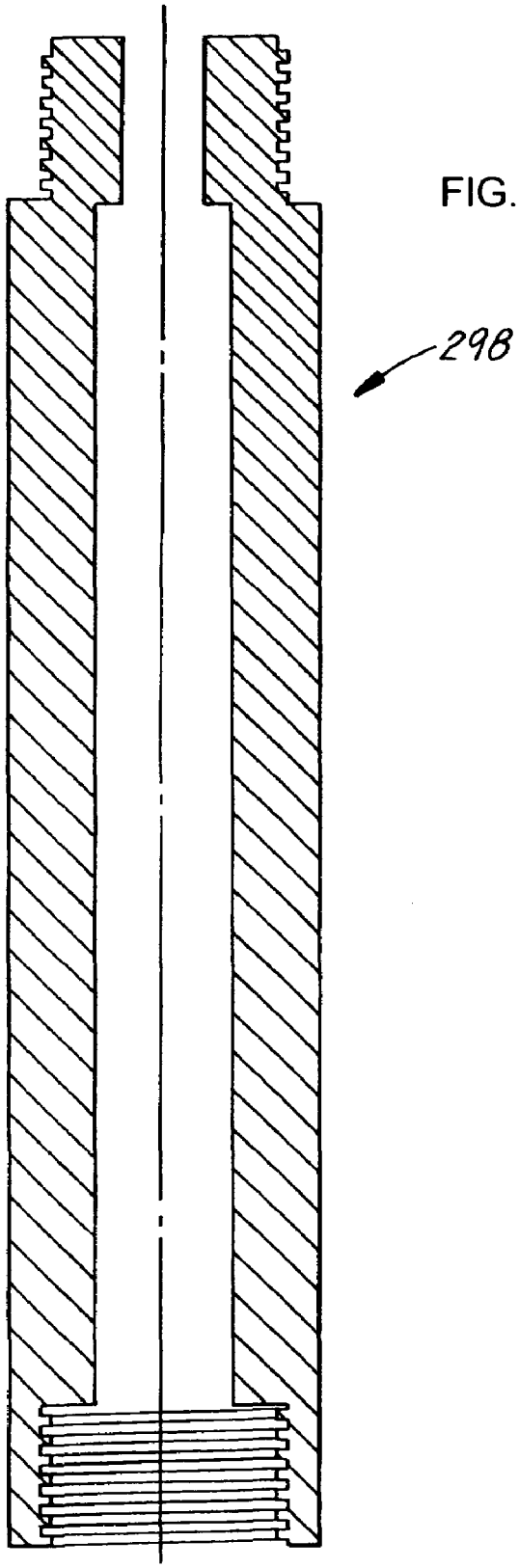

FIG. 16E there is illustrated an auxiliary weight member 298 which could be secured to the upper portion of the tool so as to give it additional weight and add additional jarring force to the operation of the tool. It would be threadably engaged to the member 215 on the housing 216 as illustrated in FIG. 16A or 16B.

Figure 16F:
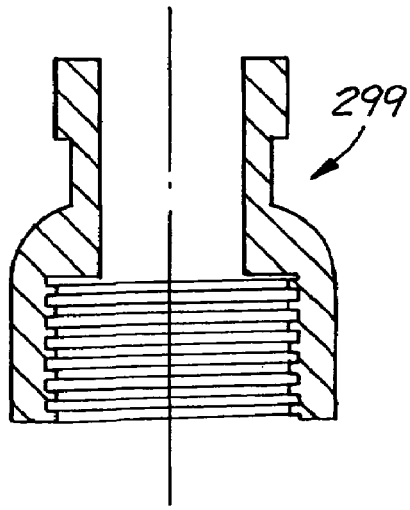
Figure 18A:
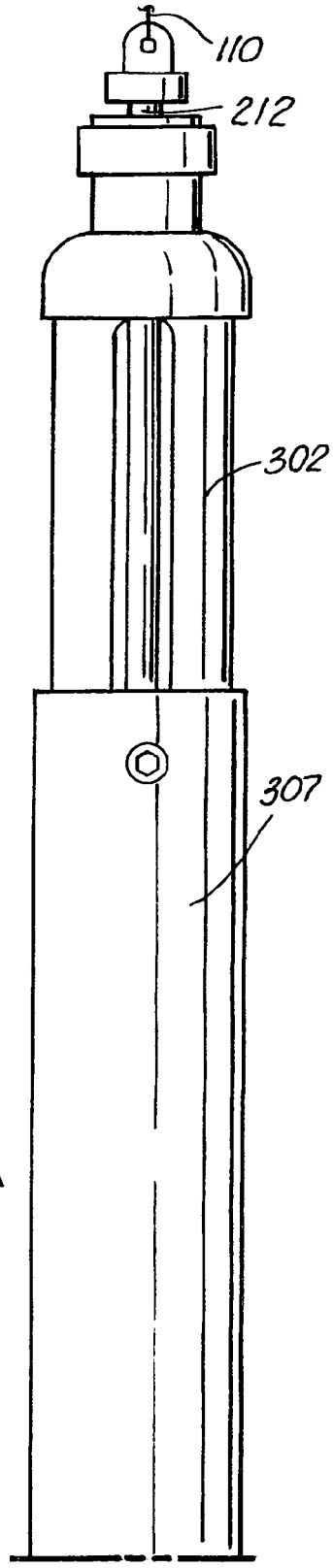
Figure 18B:
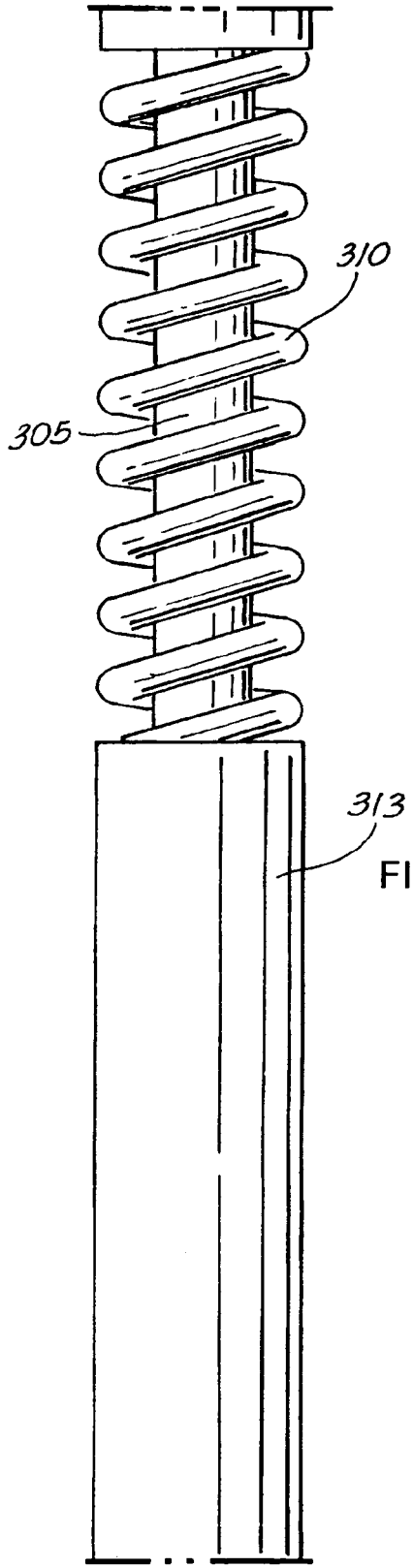
Figure 18C:
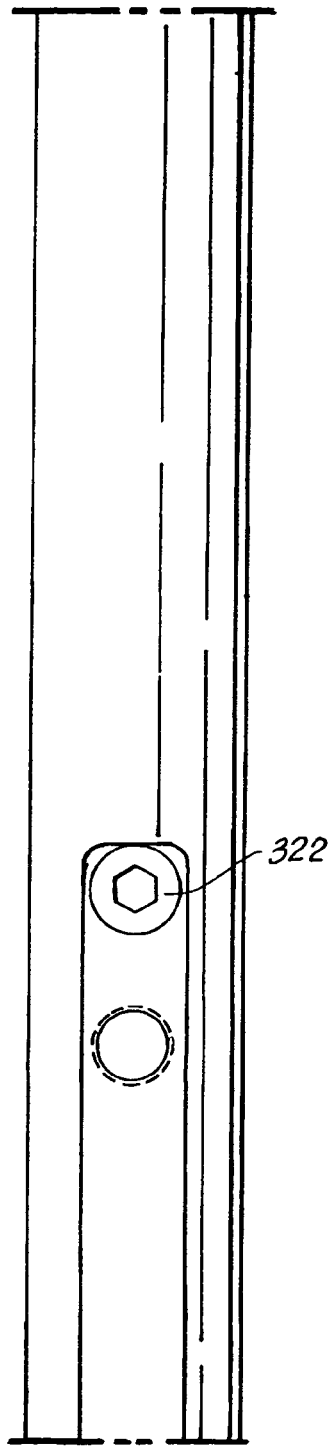

Lastly, FIG. 16F simply illustrates a tool and stem cap 299 which would be again used as a cap member with the embodiment as shown in FIGS. 16A–16F.

In FIGS. 17A through 17D, in cross section and FIGS. 18A through 18D in outer view, there is illustrated a fourth embodiment of the apparatus of the present invention. In summary, this embodiment would be utilized with slickline using a hybrid spring system incorporating an incompressible fluid energizing an exterior helical spring. This eliminates seal friction during the jarring process as well as hysteresis of Belleville springs. A simple mechanical latching system, as will be described, is incorporated using the total stroke of the tool, which is directly related to the amount of overpull applied. The firing stroke or tension can be varied by changing the length of the internal rod, as well as adjustment of the jarring stroke by inserting different sets of anvil pins.

Turning now to the drawing FIGS. 17A through 17D and 18A through 18D, there is provided the tool 300, including a tension rod 212 extending through the length of the tool body 301. There is provided an upper piston 304 which moves up and down within a chamber 306. The upper piston 304 is engaged to a slotted upper cylinder 302 with transfer pins 303. There is an internal housing 308 that forms a cylinder 305 which houses the rod 212 and defines an annular space for housing incompressible fluid 306, such as hydraulic fluid. There is provided a tension ring 307 surrounding the upper piston 304 and cylinder 305. Around the outer wall of the cylinder 305, there is provided a helical spring 310, which rests and engages a lower tool body 313. There are a pair of releasing balls 314 engaged within grooves 315 formed in the wall of the body 313. The releasing balls are engaged onto the cylinder 305 and the tension rod 212. The balls 314 are held engaged by an internal cocking sleeve 316. There is also provided a return spring 318 at the lower end of the lower piston 312.

Figure 17A:
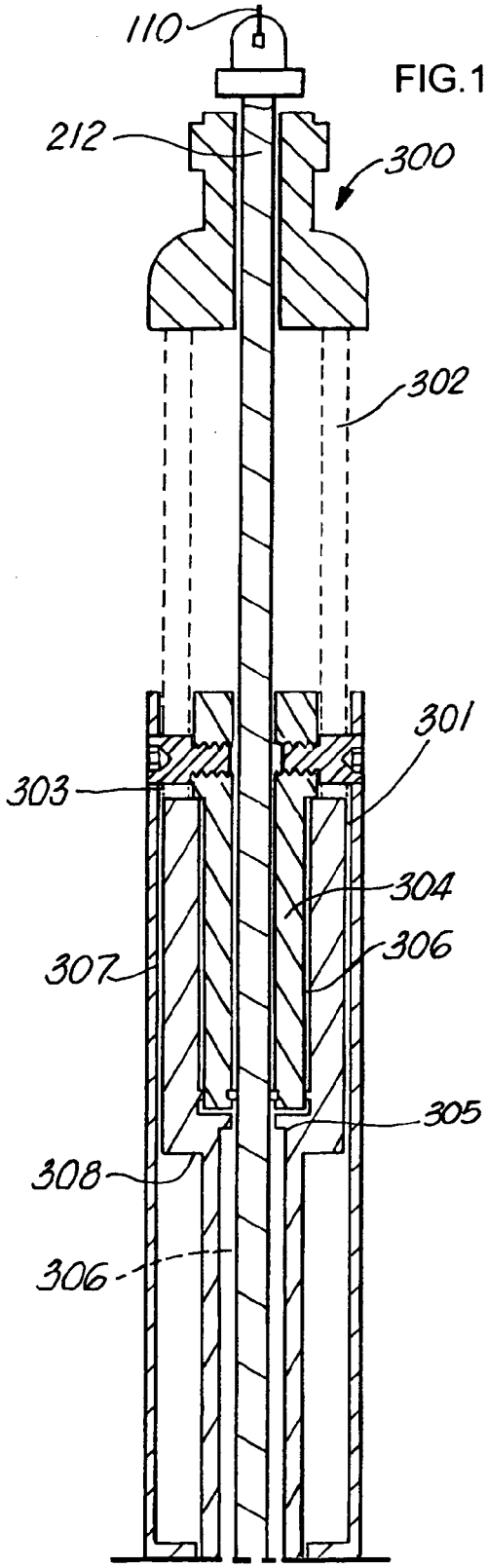
FIGS. 17A through 17D and 18A through 18D illustrate cross sectional and exterior views respectively of a fourth embodiment of the apparatus of the present invention.
Figure 17B:
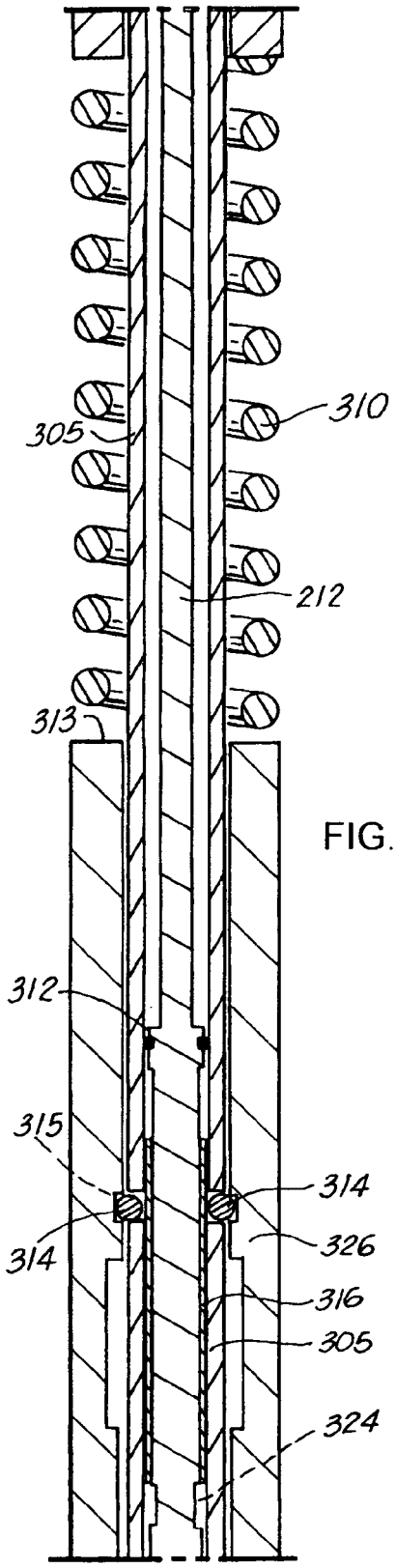
Figure 17C:
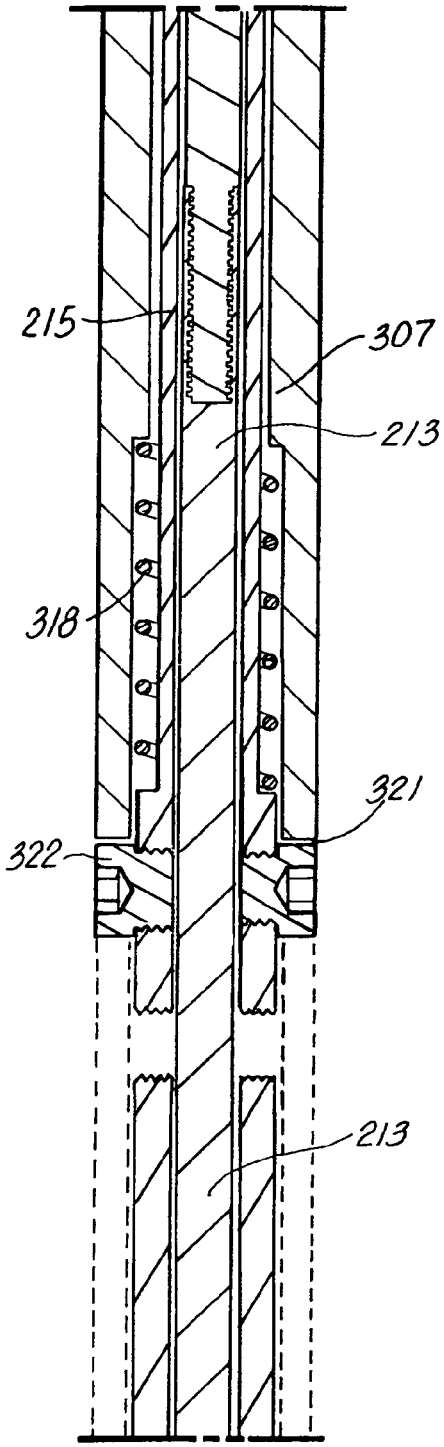
Figure 17D:
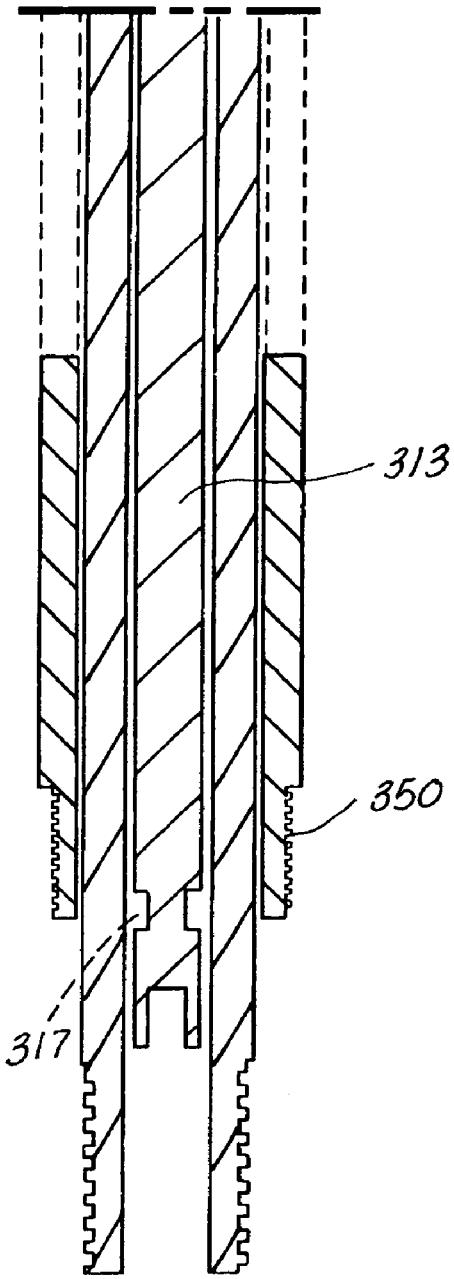
Figure 18D:
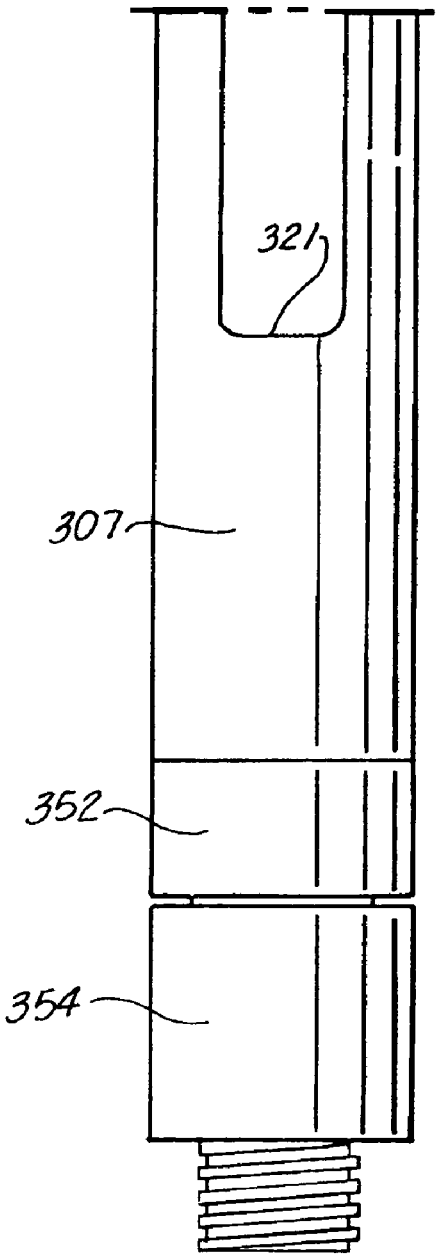

In operation when upward force is imparted on the tension rod 212, the incompressible fluid 306 is forced upward imparting force against the piston 304, which in turn is pinned via transfer pins 303 to the tension ring 307. The fluid forces piston 304 upward, which would expand helical spring 310 against the force of the fluid 306. As this upward movement occurs, the balls 314 are maintained within the openings in groves 315 by a inner sleeve 316. At some part in its upward travel the firing recess 317 at the lower end of the tension rod 212 will be brought in alignment with balls 314, which will then enter the firing recess 317 and allow the tool to fire so that the energy of the helical spring 310 imparts the upward-jarring force of the anvil pins 322 on the tool against the lower end 321 of the lower piston 312. When the tool needs to be recocked for another jarring action the inner sleeve 316 serves as a recocking sleeve and allows the balls 314 to fall within a recocking groove 324, so that the wall of the outer housing 326 can move past the balls 314 until they can be reinserted into the grooves 315 and the inner sleeve 316 return to hold them in place engaging the lower piston for another jarring operation. FIGS. 17D and 18D also illustrate the tool having threads 350 for a stem extension or stem cap 352 and a tool cap 354. For purposes of construction, the lower portion 213 of the tension rod 212 which is threadably engaged at point 215, can be replaced with a shorter rod so as to effect a shorter distance for the tension rod to travel prior to the tool firing. For purposes of construction, the anvil pins 322 may be adjustable in their position on the wall of the apparatus.

Figure 19:
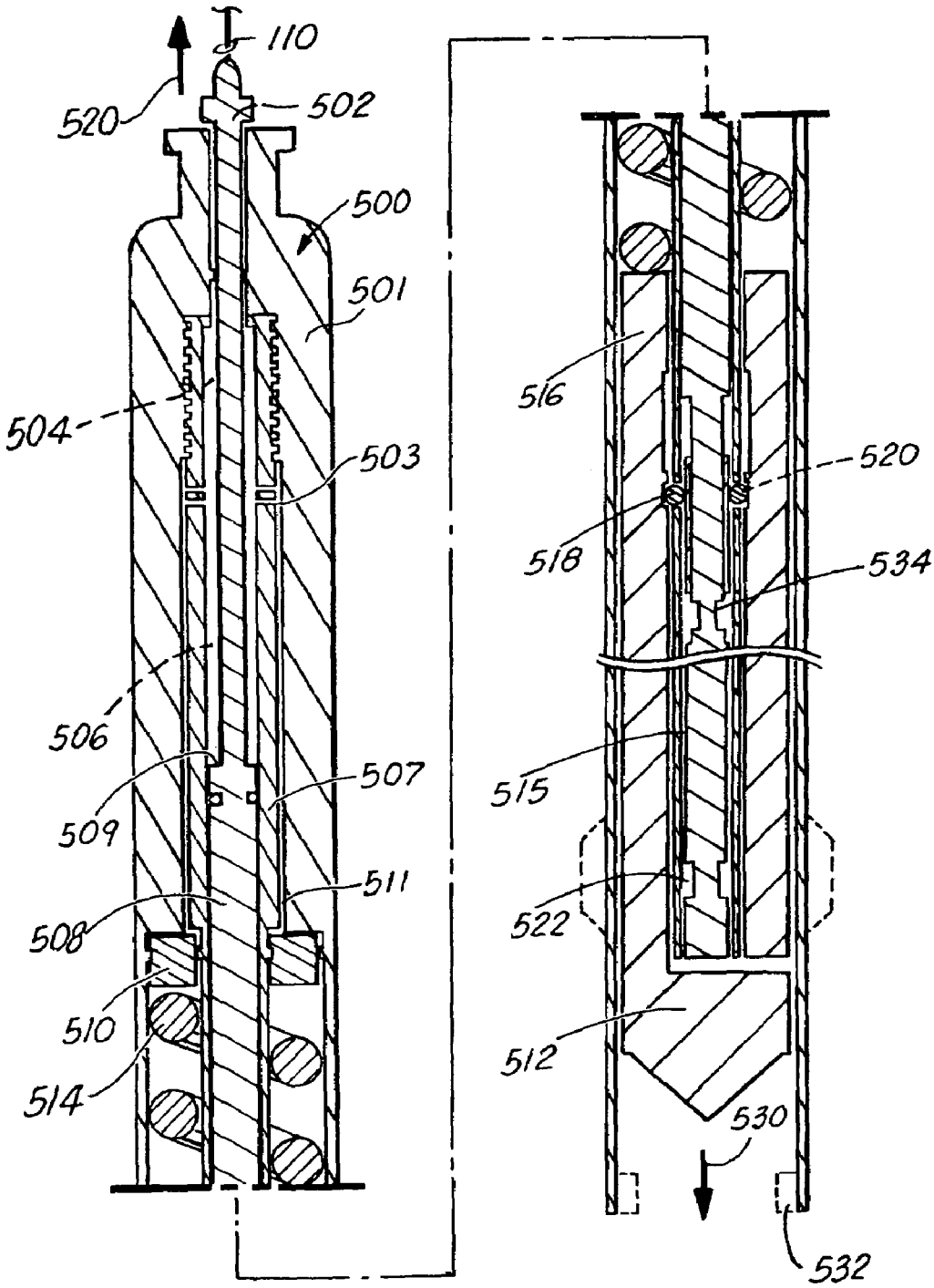
FIG. 19 illustrates an overall cross sectional view of a fifth embodiment of the apparatus of the present invention.

FIG. 19 illustrates the fifth embodiment of the apparatus of the present invention. In summary, unlike the previous embodiments, the downward jarring tool would utilize the weight of the tool itself to store energy in an enclosed helical spring. This tool would typically be used to break up junk in a tubing string or to puncture composite or glass disks used to temporarily seal the tubing string. For example if the weight of the tool is 100 pounds, the tool may be set to fire with 50 pounds of overpull a multiplying factor on the order of 8 to 10 results in a downward firing jar 450 to 500 pounds without attaching itself to the wellbore to provide a reactive force to energize the spring means. Optionally, if the tool can be located in a nipple or prerun recess in the tubing additional overpull can be employed above the weight of the tool and significantly higher drawing forces can be obtained.

Turning now to FIG. 19 there is illustrated the tool 500, including an outer housing 501. This would house an internal tension rod 502 at the end of a wireline or slick line 110. Further there is illustrated an annular space 504 between the tension rod 502 and the internal housing 507, with that space housing an incompressible fluid 506, such as hydraulic fluid. Further there is illustrated an enlarged portion 508 of rod 502, which defines a piston 509, and which extends to the lower end 512 of the tool 500. There is also annular space 511 that houses incompressible fluid 506, allowing the fluid to react downward against piston 510 when the tension rod 502 is pulled upward as indicated by arrow 520. There is further provided a helical spring 514 housed within an annular space in the outer housing 501. The helical spring 514 extending from the upper portion of the housing to a lower anvil member 516. As with the embodiment discussed in relation to FIGS. 17A through 17D and 18A through 18D, the lower portion 508 of the rod 502 includes a means for cocking and firing the tool and for recocking the tool during operation. In this regard there is provided a pair of releasing balls 518 which are housed within a recess 520 formed in the anvil 516 and extend outward to maintain the anvil in cocked relationship with the tension rod 502. Therefore, in operation, when the tension rod 502 is pulled in the direction of arrow 520, incompressible fluid 506 exerts a downward force on piston 510, compressing helical spring 514, and placing a downward force on anvil 516. The anvil is held in place via balls 518 against internal housing 507. It is noted that fluid 506 is pressurized in the upward direction but is redirected downward via ports 503 into annulus 511.

There is further provided a lower firing recess 522 so that when the anvil 516 is pulled upward beyond internal sleeve 515, the balls 518 will enter into a firing recess, which will allow the anvil 516 to move downward in the direction of arrow 530 and makes contact with the base of the tubing string or an optional internal anvil shoulder 532 in a downward jarring motion. The tool then can be recocked as the balls would enter recocking recesses 534, held therein by sleeve 515 and would be available for another jarring motion as is required.

The foregoing embodiments are presented by way of example only; the scope of the present invention is to be limited only by the following claims.

The invention claimed is:

1. A jarring apparatus that multiplies tension to provide greater overpull, the apparatus comprising:

a. an outer tube;

b. an inner tube moveable within the outer tube, attached at a first upper end to the pipe string;

c. a third tube between the outer and inner tubes that is engaged to the stuck object;

d. a compressible energizing fluid within a space between the inner and third tubes when the inner tube is raised to a first up cocked position; and e. a first differential surface area between the inner tube and the third tube and a second differential surface area between the outer tube and inner tube, so that when tension is applied to the inner tube, the tension is multiplied to the outer tube by virtue of the compressible fluid acting on the differential areas, thereby allowing the outer tube to deliver a multiplied jarring force to the stuck object.

2. The apparatus in claim 1, wherein there may be further provided a plurality of hammer and compression subs to increase the jarring force within the tool.

3. The apparatus in claim 2, wherein the compressible fluid further comprises nitrogen gas or other suitable compressible inert fluid.

4. The apparatus in claim 2, further comprising means for allowing the outer tube to move upward in a controlled manner further comprises a metering chamber for allow fluid flow therethrough.

5. The apparatus in claim 2, wherein the upward jarring force is created by the expansion of the compressed fluid within the tool to effect the tension multiplier effect.

6. A jarring apparatus that multiplies tension to provide greater overpull, the apparatus comprising:

a. an outer tube;

b. an inner tube moveable within the outer tube, attached at a first upper end to the pipe string;

c. a third tube between the outer and inner tubes that is engaged to the stuck object;

d. a compressible energizing fluid, such as nitrogen gas, within a space between the inner and third tubes when the inner tube is raised to a first up cocked position; and e. a first differential surface area between the inner tube and the third tube and a second differential surface area between the outer tube and inner tube, so that when tension is applied to the inner tube, the tension is multiplied to the outer tube by virtue of the compressible fluid acting on the differential areas, thereby allowing the outer tube to deliver a multiplied jarring force to the stuck object.

7. The apparatus in claim 6, wherein the apparatus further comprises a first anvil and metering sub, a hammer and compression sub, a multiplier sub and an upper spline sub.

8. The apparatus in claim 6, wherein there is further provided a plurality of hammer and compression subs to enhance the jarring effect of the apparatus.

9. The apparatus in claim 6, wherein the differential areas in the apparatus multiplies the overpull by a factor of 1.1 to 15 to define a greater jarring effect.

10. The apparatus in claim 6, further comprising metering fluid for metering the movement of the hammer portion before the expansion of the compressed fluid causes the hammer to jar against the anvil portion of the tool.

11. A jarring apparatus that multiplies tension to provide greater overpull, the apparatus comprising:

a. an outer tube;

b. an inner tube moveable within the outer tube, attached at a first upper end to the pipe string;

c. a third tube between the outer and inner tubes that is engaged to the stuck object;

d. raising the inner tube to a first up-cocked position; and e. compressing a first energizing fluid within a space between the inner and third tubes when the inner tube is raised to the first up-cocked position;

f. defining a first differential surface area between the inner tube and the third tube;

g. defining a second differential surface area between the outer tube and the inner tube; and h. applying tension to the inner tube so that the tension is multiplied to the outer tube by virtue of the compressible fluid acting on the differential areas thereby allowing the outer tube to deliver a multiplied jarring force to the stuck object.

12. The method in claim 11, further providing the step of providing a second fluid within the tool to meter the movement of the second tube as it moves from a first energized position to a second fired position.

13. The method in claim 12, further comprising the step of resetting the tool to an energized position to repeat steps e and f.

14. A process for multiplying the force against an object, comprising the following steps:

providing a compressive inner tube;

compressing a fluid by upward pull on the inner tube by a long stroke acting on a first piston area; and allowing the fluid to expand against a second piston area over a relatively short stroke, wherein upon expansion of the fluid the upward force is multiplied by a factor of 1.2 to 15 as a jarring force.

15. The process in claim 14, wherein the long strong multiplied by nominal tension yields a short stroke multiplied by the factor of 1.2 to 15 or greater.

16. An apparatus for providing up and down jarring to tools within a borehole, comprising:

a. a first external body section;

b. a piston rod within the first body section defining a first fluid chamber therebetween;

c. an internal shaft within a portion of the body section defining a second fluid chamber therebetween;

d. a compressible fluid housed within said first and second chambers;

e. means for exerting a compressive force on said first fluid chamber to overcome the compressive force within the second fluid chamber to the extent that the compressive force in the first chamber forces the body section and internal shaft to jar against one another imparting an upward jarring motion to the lodged tool.

17. An apparatus for providing up and down jarring to tools lodged within a borehole, comprising:

a. a first external body section;

b. a piston rod within the first body section defining a first fluid chamber;

c. an internal shaft within a portion of the body section defining a second fluid chamber;

d. a compressible fluid housed within said first and second chambers;

e. means for exerting a compressive force on said second fluid chamber to overcome the compressive force within the first fluid chamber to the extent that the compressive force in the second chamber forces the body section and internal shaft to jar against one another imparting a downward jarring motion to the lodged tool.

18. A jarring method within a bore hole, comprising the steps of:

a. providing a tool having a first external body section; a piston rod within the first body section defining a first fluid chamber; and an internal shaft within a portion of the body section defining a second fluid chamber;

b. filling the first fluid chamber with a quantity of compressible fluid to provide a fluid pressure within the first fluid chamber;

c. filling the second fluid chamber with a quantity of compressible fluid to provide a fluid pressure within the second fluid chamber;

d. compressing the fluid in the first fluid chamber to a pressure exceeding the pressure in the second fluid chamber;

e. allowing the fluid in the first fluid chamber to expand with a force capable of exerting an upward jarring force between the internal shaft and the body section.

19. A method of jarring a tool in a bore hole, comprising the steps of:

a. providing a tool having a first external body section; a piston rod within the first body section defining a first fluid chamber; and an internal shaft within a portion of the body section defining a second fluid chamber;

b. filling the first fluid chamber with a quantity of compressible fluid to provide a fluid pressure within the first fluid chamber;

c. filling the second fluid chamber with a quantity of compressible fluid to provide a fluid pressure within the second fluid chamber;

d. compressing the fluid in the second fluid chamber to a psi exceeding the psi in the first fluid chamber;

e. allowing the fluid in the second fluid chamber to expand with a force capable of exerting a downward jarring force between the internal shaft and the body section.

20. An apparatus for jarring downward by multiplying tension to provide a greater downward force, the apparatus comprising:

a. an outer housing;

b. an inner housing;

c. a tension rod moveable within the inner and outer housings, the tension rod attached at a first upper end to a line;

d. a spring member positioned within an annular space between the outer and inner tubes extending to a lower anvil member;

e. a incompressible fluid within a space between the tension rod and the inner housing so that when the tension rod is pulled upward, the incompressible fluid exerts a compression force on the spring member;

e. means for releasing the tension rod from the raised cocked position to energize the spring with a downward jarring force.

21. The apparatus in claim 20, wherein there are provided differential surface areas related to the fluid and spring for multiplying the upward force against the lodged tool upon release of the spring means.

22. The apparatus in claim 20, wherein hydrostatic pressure in the tube is balanced by ambient pressure acting on an upper piston and on the lower end of the rod and a lower piston.

23. The apparatus in claim 20, wherein a firing mechanism of the tool comprises balls moving from a first position within first grooves when the tool is in a cocked position and to a second position into firing grooves when the tool is fired.

24. The apparatus in claim 20, whereby the tool can be activated without external attachments to the wellbore, wherein the reactive force required to energize the spring means is supplied by the weight of the tool itself.

* * * * *